US009513579B2

(12) United States Patent
Makie et al.

(10) Patent No.: US 9,513,579 B2
(45) Date of Patent: Dec. 6, 2016

(54) DEVELOPER REPLENISHING APPARATUS INCLUDING CONTAINER HAVING MOVING WALL

(71) Applicant: KYOCERA Document Solutions Inc., Osaka-shi, Osaka (JP)

(72) Inventors: Ikuo Makie, Osaka (JP); Hiroyuki Hamakawa, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/006,411

(22) Filed: Jan. 26, 2016

(65) Prior Publication Data

US 2016/0216641 A1 Jul. 28, 2016

(30) Foreign Application Priority Data

Jan. 28, 2015 (JP) ..... 2015-014319
Jan. 30, 2015 (JP) ..... 2015-016938

(51) Int. Cl.
*G03G 15/08* (2006.01)

(52) U.S. Cl.
CPC ..... *G03G 15/0894* (2013.01); *G03G 15/0856* (2013.01); *G03G 2215/066* (2013.01)

(58) Field of Classification Search
CPC ..... G03G 15/0832; G03G 15/0834; G03G 15/0853; G03G 15/0856; G03G 15/0867; G03G 15/0868; G03G 15/087; G03G 15/0894; G03G 2215/066; G03G 2215/0663; G03G 2215/0668; G03G 2215/0685
USPC ..... 399/258, 262
See application file for complete search history.

(56) References Cited

U.S. PATENT DOCUMENTS

| | | | | |
|---|---|---|---|---|
| 7,650,103 | B2 * | 1/2010 | Isomura | G03G 15/0868 399/258 |
| 9,134,651 | B1 * | 9/2015 | Eto | G03G 15/0877 |
| 2005/0129417 | A1 * | 6/2005 | Asakura | G03G 15/0856 399/27 |
| 2007/0223947 | A1 | 9/2007 | Ohkawa et al. | |

(Continued)

FOREIGN PATENT DOCUMENTS

| | | |
|---|---|---|
| EP | 1 076 271 | 2/2001 |
| JP | 2001-92230 | 4/2001 |
| JP | 2007-264073 | 10/2007 |

*Primary Examiner* — Sophia S Chen
(74) *Attorney, Agent, or Firm* — Gerald E. Hespos; Michael J. Porco; Matthew T. Hespos

(57) ABSTRACT

A developer replenishing apparatus includes a developer housing container and a sensor. The developer housing container includes a container main body having a wall that partitions an internal space, a shaft section arranged so as to extend in a first direction in the internal space, a moving wall which moves from an upstream side to a downstream side in the first direction along the shaft section and which conveys the developer, and a developer discharge port which is arranged near a downstream end in the first direction of the container main body. The sensor is arranged at a position that enables the sensor to generate different outputs between before and after the moving wall reaches a prescribed position on a movement route. The determining unit determines a state where there is no developer in the developer housing container when the sensor generates an output determined in advance.

15 Claims, 24 Drawing Sheets

(56) References Cited

U.S. PATENT DOCUMENTS

| | | | | |
|---|---|---|---|---|
| 2009/0214230 | A1* | 8/2009 | Kweon | G03G 15/0856 399/262 X |
| 2011/0020017 | A1* | 1/2011 | Takahashi | G03G 15/0853 399/258 X |
| 2014/0079441 | A1* | 3/2014 | Abler | G03G 15/0868 399/262 |
| 2016/0033903 | A1* | 2/2016 | Eto | G03G 15/0867 399/262 |

* cited by examiner

DEVELOPER REPLENISHING APPARATUS INCLUDING CONTAINER HAVING MOVING WALL

INCORPORATION BY REFERENCE

This application is based on, and claims priority from, Japanese Patent Application No. 2015-14319 filed on Jan. 28, 2015 with the Japan Patent Office, and Japanese Patent Application No. 2015-16938 filed on Jan. 30, 2015 with the Japan Patent Office, the entire contents of which are incorporated herein by reference.

BACKGROUND

The present disclosure relates to a developer replenishing apparatus that replenishes developer and to an image forming apparatus to which the developer replenishing apparatus is applied.

In an image forming apparatus adopting an electrophotographic system, toner (developer) is supplied from a developing apparatus to a peripheral surface of a photoconductive drum in order to develop an electrostatic latent image on the photoconductive drum. In accordance with consumption of the toner, toner is replenished from a toner container (developer housing container) to the developing apparatus. Desirably, the toner housed in the toner container is used up completely, leaving as little toner in the container as possible. However, there are cases where toner remains inside the container due to, for instance, adherence of toner on an inner wall surface of the container.

In consideration of the problem described above, a toner container is known in which a moving wall is arranged inside the container. The moving wall moves so as to approach a toner discharge port in accordance with a remaining toner amount. The movement of the moving wall is controlled based on a detection result of a toner sensor arranged near the toner discharge port. According to such a toner container, since the toner inside the container is conveyed by the moving wall, all of the toner can be guided to the toner discharge port without leaving any toner on the inner wall surface or the like.

SUMMARY

A developer replenishing apparatus according to an aspect of the present disclosure includes a developer housing container that houses developer, a sensor, and a determining unit. The sensor detects a prescribed detection object and generates an electrical output. The determining unit determines a presence or absence of developer inside the developer housing container based on an output from the sensor.

The developer housing container includes a container main body having a wall that partitions an internal space, a shaft section arranged so as to extend in a first direction in the internal space, a moving wall which moves from an upstream side to a downstream side in the first direction along the shaft section in the internal space and which conveys the developer, and a developer discharge port which is arranged near a downstream end in the first direction of the container main body and which penetrates the wall and allows communication between the internal space and the outside.

The sensor is arranged at a position that enables the sensor to generate different outputs between before and after the moving wall reaches a prescribed position on a movement route. The determining unit determines a state where there is no developer in the developer housing container when the sensor generates an output determined in advance.

An image forming apparatus according to another aspect of the present disclosure includes the developer replenishing apparatus described above, an image bearing member that bears an electrostatic latent image and a developer image, a developing apparatus to which the developer is supplied from the developer replenishing apparatus and which supplies the developer to the image bearing member, and a transferring unit which transfers the developer image from the image bearing member to a sheet.

DETAILED DESCRIPTION

Figure 1:
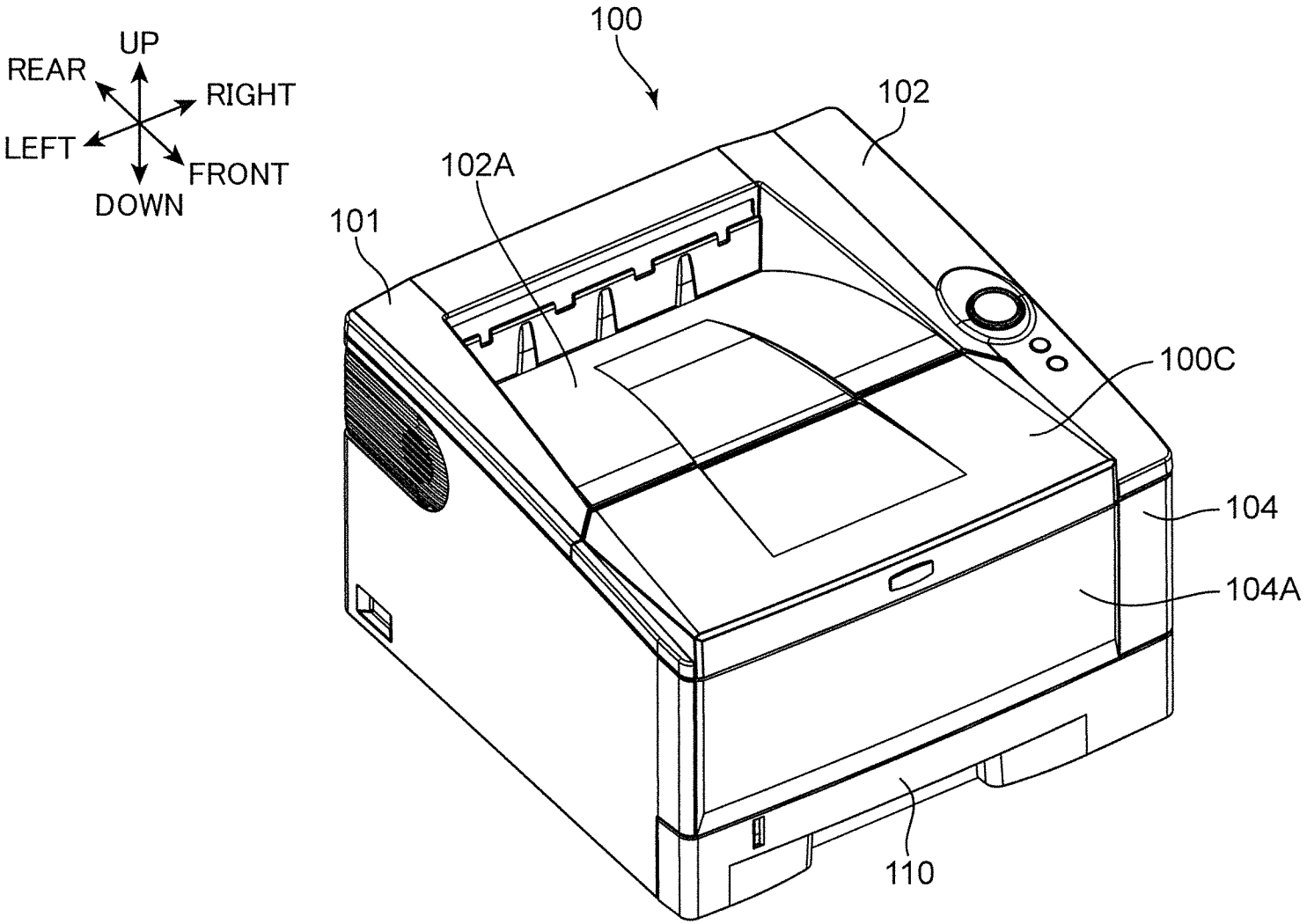
FIG. 1 is a perspective view showing an image forming apparatus according to an embodiment of the present disclosure.
Figure 2:
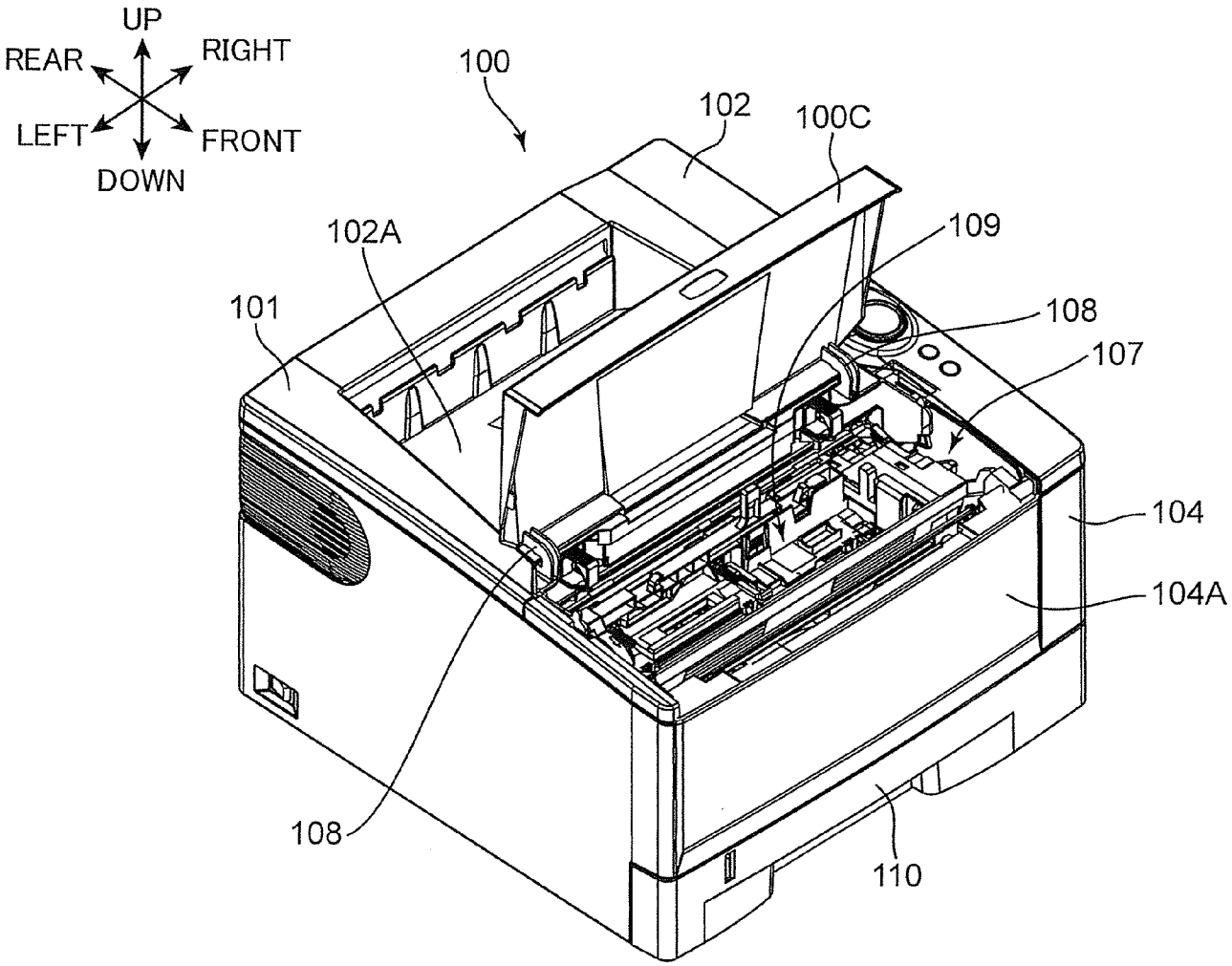
FIG. 2 is a perspective view of a state where a case of the image forming apparatus is partially opened.
Figure 3:
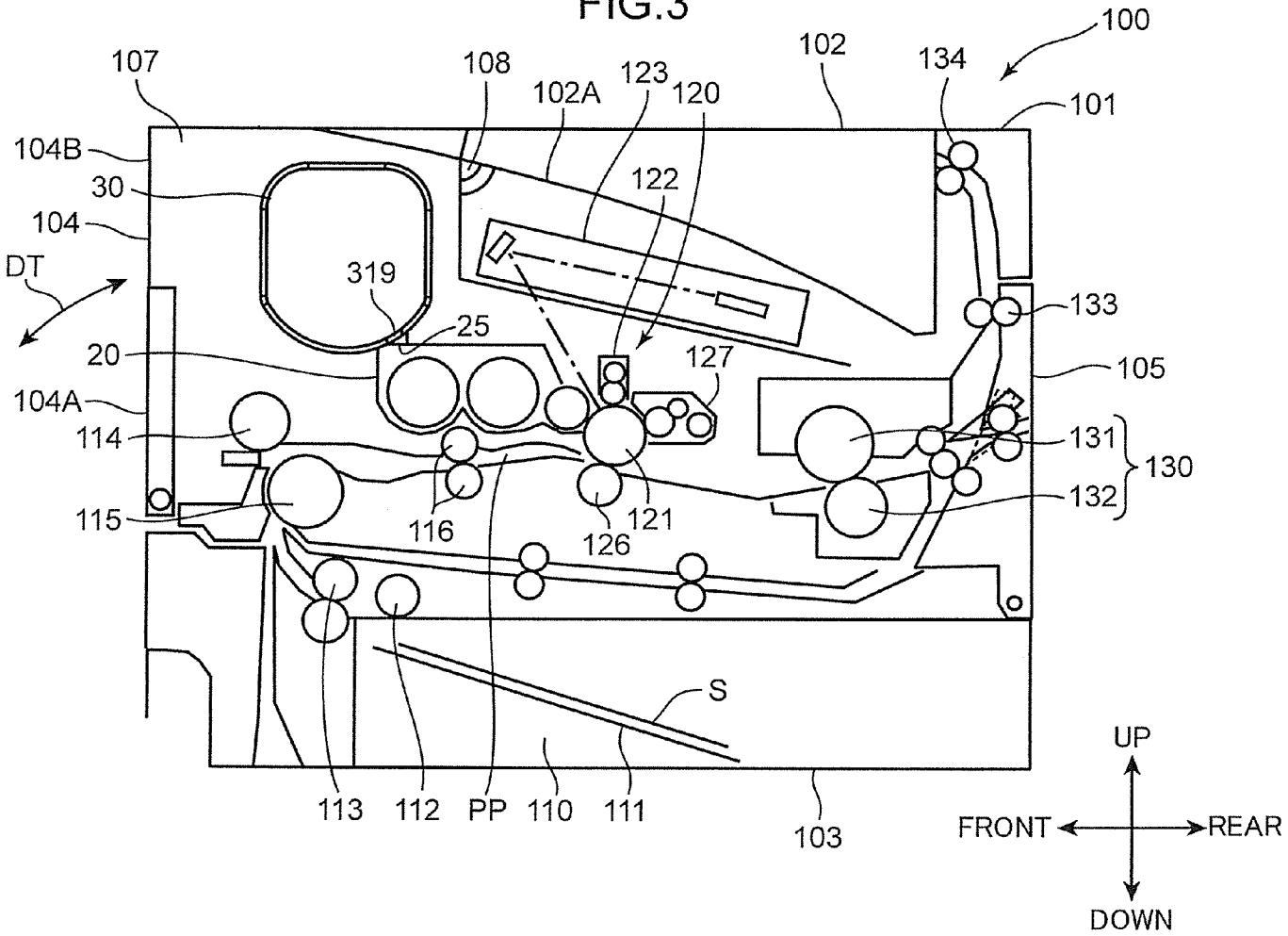
FIG. 3 is a schematic sectional view showing an internal structure of the image forming apparatus.

Hereinafter, embodiments of the present disclosure will be described in detail with reference to the drawings. FIG. 1 is a perspective view showing a printer 100 (an image forming apparatus) according to an embodiment of the present disclosure, FIG. 2 is a perspective view showing a case 101 of the printer 100 being partially opened, and FIG. 3 is a schematic sectional view showing an internal structure of the printer 100. While the printer 100 is a so-called monochrome printer, in other embodiments, the image forming apparatus may be a color printer, a facsimile apparatus, a multifunction machine equipped with functions thereof, and the like.

The printer 100 includes the case 101 that houses various devices for forming an image on a sheet S. The case 101 includes a top wall 102 that defines a top surface of the case 101, a bottom wall 103 (FIG. 3) that defines a bottom surface of the case 101, a rear wall 105 (FIG. 3) between the top wall 102 and the bottom wall 103, and a front wall 104 positioned in front of the rear wall 105. The case 101 includes an internal space 107 in which the various devices are arranged. The internal space 107 of the case 101 includes a sheet conveying path PP on which the sheet S is conveyed in a prescribed conveyance direction. As shown in FIG. 2, a part of the case 101 can be opened by an opening/closing cover 100C. When the opening/closing cover 100C is rotated around an axis of a hinge shaft 108 and opened upward, an upper part of the internal space 107 is opened to the outside. A portion that is exposed by this opening operation is a container housing section 109 for housing a toner container 30 (to be described later).

A paper discharge unit 102A is arranged in a central portion of the top wall 102. The sheet S on which an image is formed at an image forming unit 120 (to be described later) is discharged to the paper discharge unit 102A. A manual feed tray 104A is arranged in a central portion in a vertical direction of the front wall 104. The manual feed tray 104A is vertically rotatable with a lower end thereof as a fulcrum (an arrow DT in FIG. 3).

Referring to FIG. 3, the printer 100 includes a cassette 110, a pickup roller 112, a first paper supply roller 113, a second paper supply roller 114, a conveyance roller 115, a pair of paper stop rollers 116, the image forming unit 120, and a fixing apparatus 130.

The cassette 110 internally houses the sheet S. The cassette 110 includes a lift plate 111 that tilts so as to push up a leading edge of the sheet S. The pickup roller 112 is arranged above the leading edge of the sheet S having been pushed up by the lift plate 111. As the pickup roller 112 rotates, the sheet S is drawn out from the cassette 110. The first paper supply roller 113 is arranged on a downstream side of the pickup roller 112 and sends the sheet S further downstream. The second paper supply roller 114 is arranged on an inner side (rear side) of the fulcrum of the manual feed tray 104A and pulls the sheet S on the manual feed tray 104A into the case 101.

The conveyance roller 115 is arranged on a downstream side in a sheet conveyance direction of the first paper supply roller 113 and the second paper supply roller 114. The conveyance roller 115 conveys the sheet S fed out by the first paper supply roller 113 and the second paper supply roller 114 further downstream. The pair of paper stop rollers 116 has a function of correcting skewed conveyance of the sheet S. In addition, the pair of paper stop rollers 116 supplies the sheet S to the image forming unit 120 in accordance with a timing of image formation by the image forming unit 120.

The image forming unit 120 includes a photoconductive drum 121 (an image bearing member), a charger 122, an exposing apparatus 123, a developing apparatus 20, the toner container 30 (a developer housing container; a part of the developer replenishing apparatus), a transfer roller 126 (a transferring unit), and a cleaning apparatus 127.

The photoconductive drum 121 is a cylindrical member which bears an electrostatic latent image and a toner image (a developer image) on a peripheral surface thereof. The charger 122 approximately uniformly charges the peripheral surface of the photoconductive drum 121. The exposing apparatus 123 forms an electrostatic latent image on the peripheral surface of the photoconductive drum 121. The exposing apparatus 123 includes a light source such as a laser diode, a deflector, a scanning lens, an optical element, and the like and irradiates the peripheral surface of the photoconductive drum 121 having been approximately uniformly charged by the charger 122 with laser light in accordance with image data.

The developing apparatus 20 supplies toner (developer) to the peripheral surface of the photoconductive drum 121 on which an electrostatic latent image has been formed. The toner container 30 is a container housing toner and replenishes the toner to the developing apparatus 20. As the developing apparatus 20 supplies toner to the photoconductive drum 121, the electrostatic latent image formed on the peripheral surface of the photoconductive drum 121 is developed (visualized). As a result, a toner image is formed on the peripheral surface of the photoconductive drum 121. Detailed structures of the developing apparatus 20 and the toner container 30 will be described later.

The transfer roller 126 is arranged so as to oppose the photoconductive drum 121 from below and, together with the photoconductive drum 121, forms a transfer nip unit. A transferring bias is applied to the transfer roller 126 to cause the toner image formed on the photoconductive drum 121 to be transferred to the sheet. The cleaning apparatus 127 removes toner remaining on the peripheral surface of the photoconductive drum 121 after the toner image is transferred to the sheet S.

The fixing apparatus 130 includes a fixing roller 131 with a built-in heater and a pressure roller 132 arranged opposite to the fixing roller 131. The fixing apparatus 130 applies heat and pressure to the sheet on which the toner image has been transferred in order to fix the toner image onto the sheet.

A pair of conveyance rollers 133 and a pair of discharge rollers 134 arranged on a downstream side of the pair of conveyance rollers 133 are arranged on a downstream side of the fixing apparatus 130. The sheet S after the fixing process is conveyed upward by the pair of conveyance rollers 133 and, eventually, discharged from the case 101 by the pair of discharge rollers 134. The sheet S discharged from the case 101 is stacked on top of the paper discharge unit 102A.

Figure 4A:
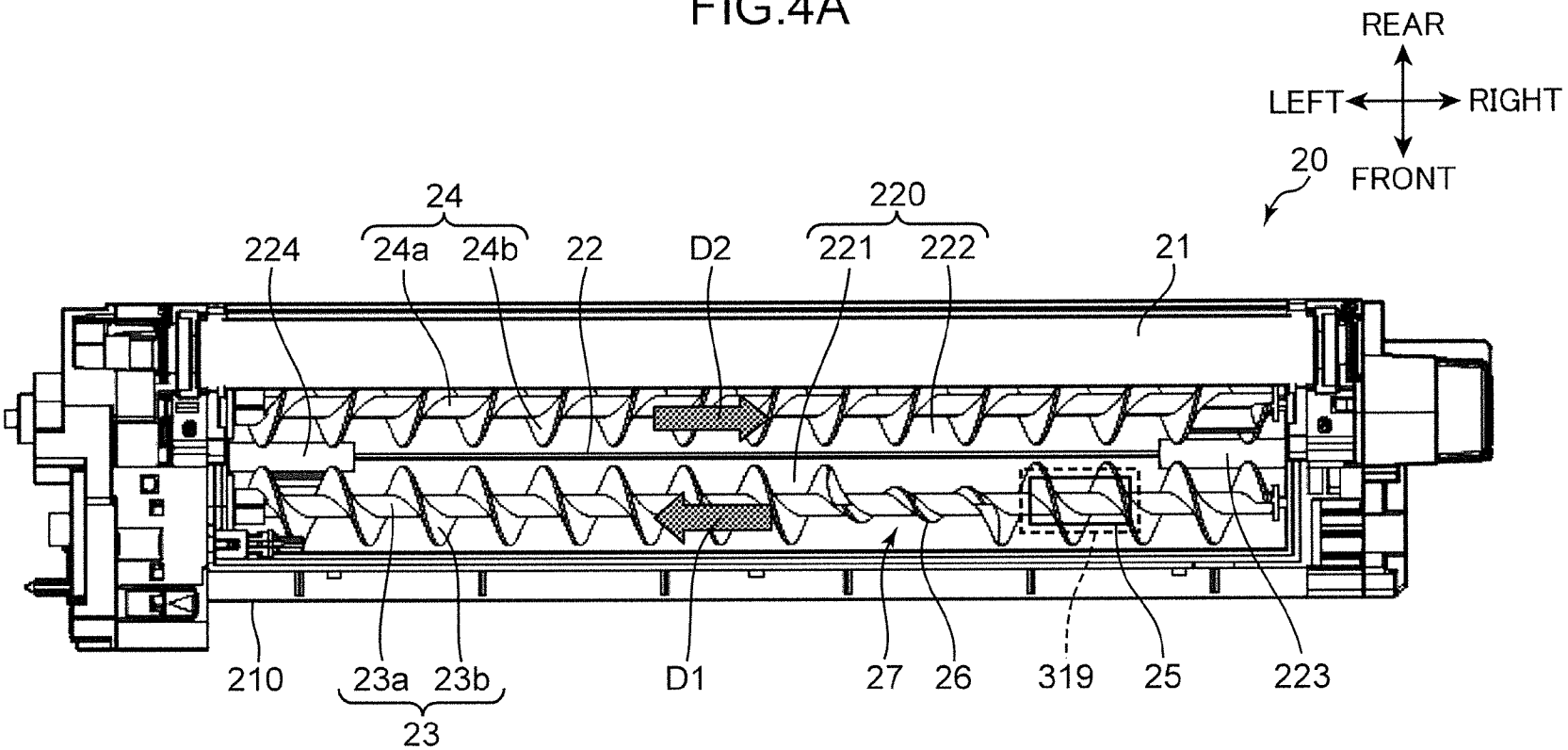
FIG. 4A is a plan view showing an internal structure of a developing apparatus included in the image forming apparatus.

Next, the developing apparatus 20 will be described in detail. FIG. 4A is a plan view showing an internal structure of the developing apparatus 20. The developing apparatus 20 includes a developing housing 210 having a box shape that is elongated in one direction (a horizontal direction). The developing housing 210 includes a storage space 220 and a toner replenishing port 25. A developing roller 21, a first stirring screw 23, and a second stirring screw 24 are arranged in the storage space 220. A one-component development system is applied in the present embodiment and, accordingly, the storage space 220 is filled with magnetic toner containing a magnetic component as developer. In other embodiments in which a two-component development system is applied, the storage space 220 is filled with developer combining toner and a carrier constituted by a magnetic body. The toner is stirred and conveyed in the storage space 220 and successively supplied from the developing roller 21 to the photoconductive drum 121 in order to develop electrostatic latent images. The developing roller 21 has a cylindrical shape that extends in a longitudinal direction of the developing housing 210 and includes a rotationally driven sleeve portion on an outer periphery thereof.

The storage space 220 of the developing housing 210 is covered by a top plate (not shown) and partitioned into a first conveyance path 221 and a second conveyance path 222 that are elongated in a horizontal direction by a partition plate 22 that extends in the horizontal direction. The partition plate 22 is shorter than a horizontal width of the developing housing 210 and a right end and a left end of the partition plate 22 are provided with a first communication path 223 and a second communication path 224 which respectively allow communication between the first conveyance path 221 and the second conveyance path 222. Accordingly, a circulation route connecting the first conveyance path 221, the second communication path 224, the second conveyance path 222, and the first communication path 223 is formed in the storage space 220. Toner is conveyed clockwise on the circulation route as indicated by arrows D1 and D2 in FIG. 4A.

The toner replenishing port 25 is an opening perforated in the top plate and is arranged above a vicinity of a right end of the first conveyance path 221. The toner replenishing port 25 is an opening which is arranged so as to oppose the circulation route described above for receiving replenishing toner that is replenished from the toner container 30 into the storage space 220.

The first stirring screw 23 is arranged in the first conveyance path 221. The first stirring screw 23 includes a first rotary shaft 23*a* and a first spiral blade 23*b* provided on a periphery of the first rotary shaft 23*a* so as to spirally protrude therefrom. As the first stirring screw 23 is rotationally driven around the first rotary shaft 23*a*, the first stirring screw 23 conveys toner in a direction of the arrow D1 in FIG. 4A. The first stirring screw 23 conveys developer so that the developer passes a position where the toner replenishing port 25 opposes the first conveyance path 221. Accordingly, the first stirring screw 23 conveys new toner that flows in from the toner replenishing port 25 and toner conveyed from the side of the second conveyance path 222 to the first conveyance path 221 while mixing the toners. The toner conveyed to a downstream end in the direction D1 by the first stirring screw 23 is delivered to the second conveyance path 222 via the second communication path 224.

A small blade section 26 in which an outer diameter of the first spiral blade 23*b* is partially set to a small diameter only in a specific section in a horizontal direction is formed on a downstream side in the toner conveyance direction of the first stirring screw 23 with respect to the toner replenishing port 25. In the small blade section 26, toner conveying capability declines in accordance with the smaller blade diameter as compared to other portions of the first spiral blade 23*b*. In other words, a region in which the small blade section 26 is formed constitutes a conveying capability suppressing unit 27 that partially suppresses toner conveying capability. The conveying capability suppressing unit 27 is provided in order to cause toner to be retained in a vicinity of the toner replenishing port 25.

The second stirring screw 24 is arranged in the second conveyance path 222. The second stirring screw 24 includes a second rotary shaft 24*a* and a second spiral blade 24*b* provided on a periphery of the second rotary shaft 24*a* so as to spirally protrude therefrom. As the second stirring screw 24 is rotationally driven around the second rotary shaft 24*a*, the second stirring screw 24 supplies toner to the developing roller 21 while conveying the toner in a direction of the arrow D2. The toner conveyed to a downstream end in the direction D2 by the second stirring screw 24 is delivered to the first conveyance path 221 via the first communication path 223.

The toner container 30 (FIG. 3) is arranged above the toner replenishing port 25 of the developing housing 210. The toner container 30 includes a toner discharge port 319 (a developer discharge port). The toner replenishing port 25 of the developing apparatus 20 is opened to the developing housing 210 at a corresponding position below the toner discharge port 319. Toner stored in the toner container 30 is replenished to the inside of the developing housing 210 from the toner discharge port 319 through the toner replenishing port 25.

Figure 4B:
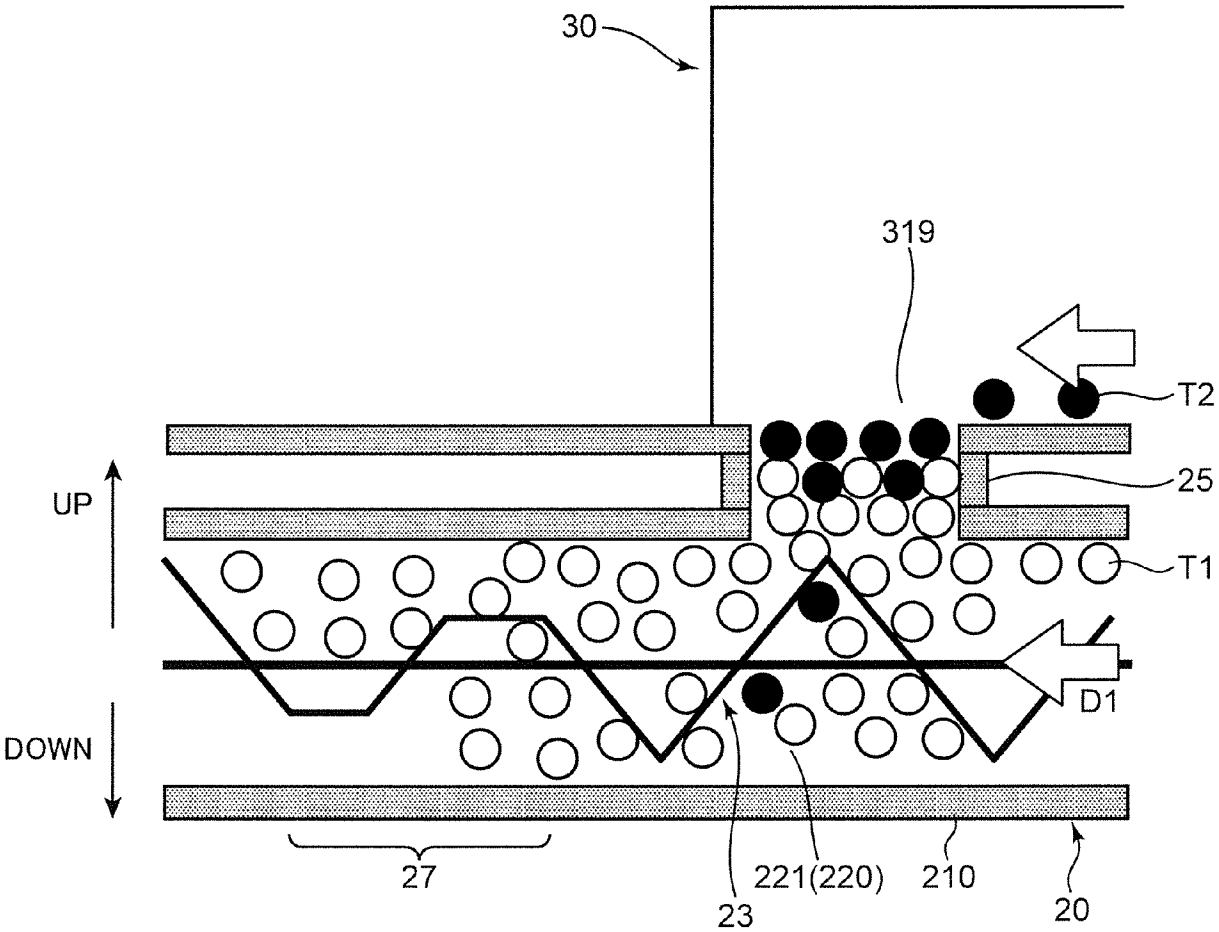
FIG. 4B is a schematic sectional view showing how developer is replenished to the developing apparatus.

As a system for replenishing toner to the developing apparatus 20, the present embodiment adopts a volume-based replenishing system in which, when a toner amount in the developing apparatus 20 decreases, toner is naturally replenished from the toner container 30 without being dependent on a toner sensor. A flow of toner newly replenished from the toner replenishing port 25 in the volume-based replenishing system will now be described. FIG. 4B is a sectional view schematically showing a vicinity of a junction of the toner replenishing port 25 of the developing apparatus 20 and the toner discharge port 319 of the toner container 30.

Replenishing toner T2 supplied from the toner discharge port 319 drops to the first conveyance path 221 and is mixed with existing toner T1, and conveyed in the direction of the arrow D1 by the first stirring screw 23. At this point, the toners T1 and T2 are stirred and charged. As described above, the first stirring screw 23 includes the conveying capability suppressing unit 27 with relatively low toner conveying performance on a downstream side in the toner conveyance direction with respect to the toner replenishing port 25. When the first stirring screw 23 is rotationally driven in a state where sufficient toner exists in the storage space 220, the toner T1 starts to accumulate at the conveying capability suppressing unit 27. The toner T1 accumulates to a position which is on an immediately upstream side of the conveying capability suppressing unit 27 and at which the toner replenishing port 25 opposes the first conveyance path 221. As a result, an inlet of the toner replenishing port 25 is blocked by the accumulated toner T1.

Therefore, in a state where toner sufficiently exists in the storage space 220, the replenishing toner T2 is unable to drop from the toner discharge port 319. Therefore, replenishing of the replenishing toner T2 is restricted. On the other hand, when toner inside the storage space 220 is consumed and the toner accumulated at the conveying capability suppressing unit 27 decreases, the toner blocking the toner replenishing port 25 also decreases. As a result, the replenishing toner T2 can flow into the first conveyance path 221 (the storage space 220) from the toner replenishing port 25 and replenishing of toner is achieved. Moreover, in a case where a toner sensor is annexed to the developing apparatus 20 and replenishing of toner is performed while being totally dependent on the toner sensor (in a case where a volume-based replenishing system is not adopted), a configuration may be adopted where the conveying capability suppressing unit 27 is not provided.

[Developer Housing Container According to First Embodiment]

Figure 5:
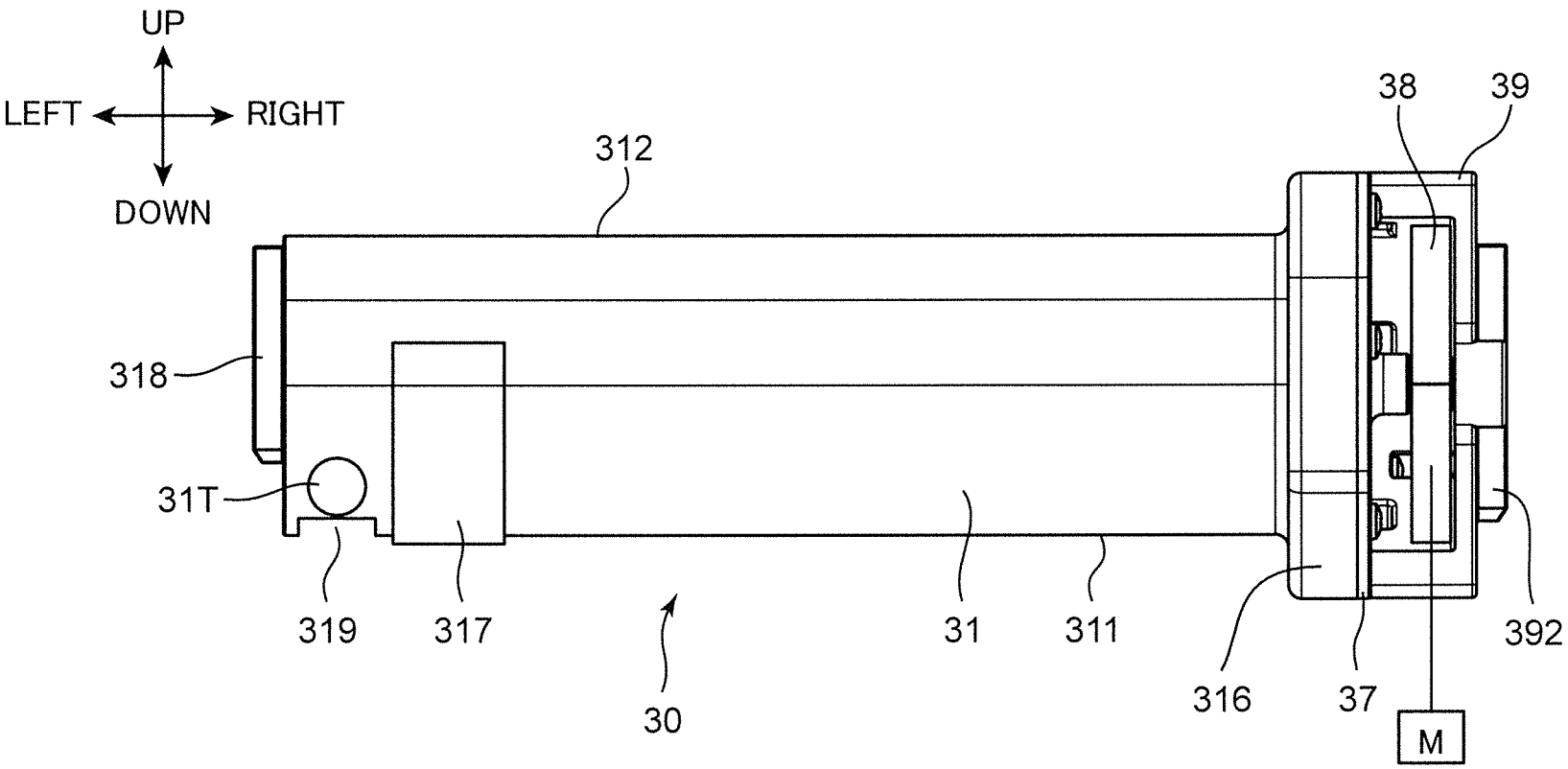
FIG. 5 is a side view showing a developer housing container according to a first embodiment of the present disclosure.
Figure 6:
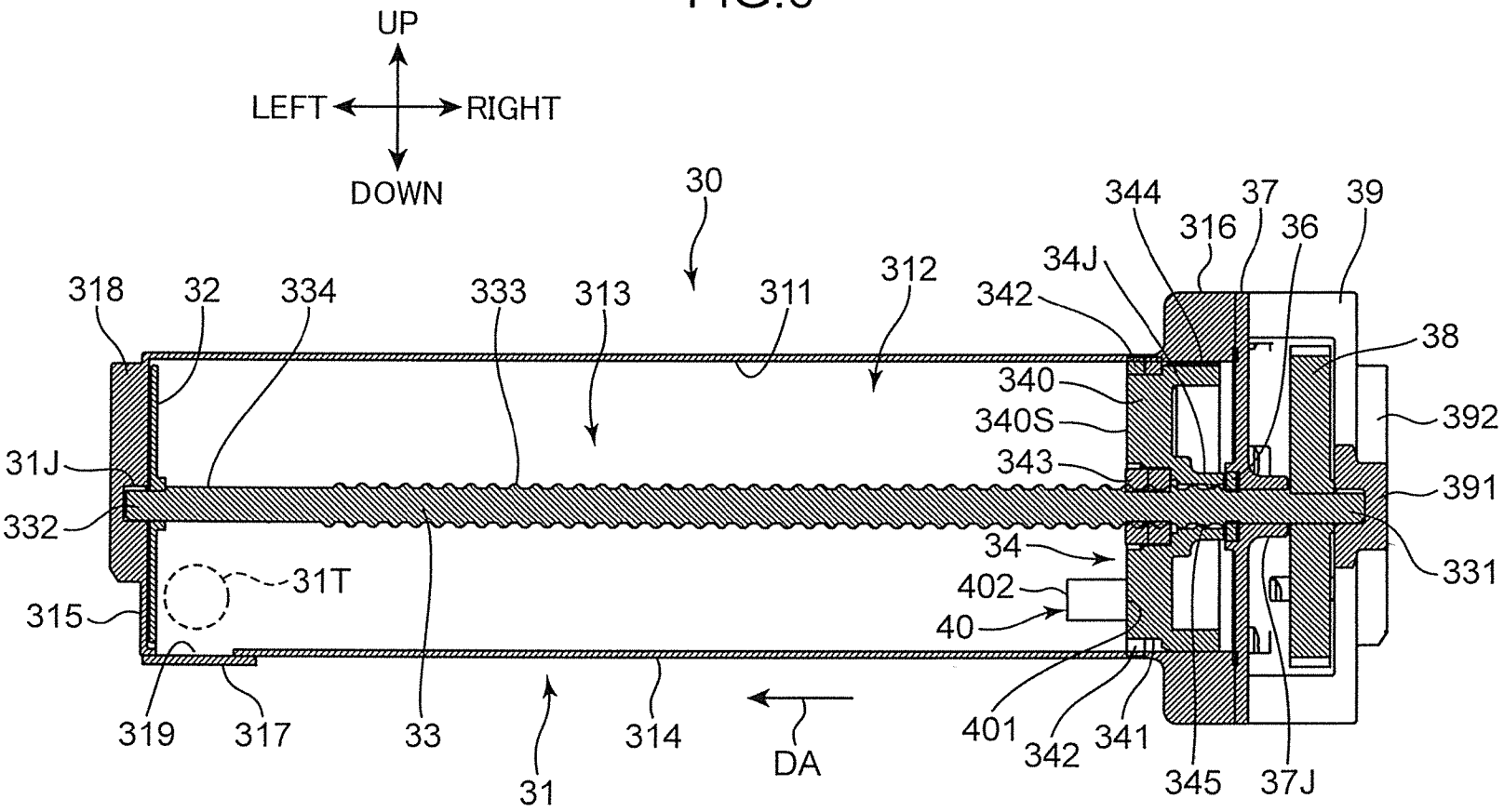
FIG. 6 is a sectional view in a horizontal direction of the developer housing container shown in FIG. 5.

Next, a detailed structure of the toner container 30 according to the first embodiment will be described. FIG. 5 is a side view of the toner container 30 and FIG. 6 is a horizontal sectional view of the toner container 30. The toner container 30 includes a container main body 31 (a container main body), a stirring disk 32, a shaft 33 (a shaft section), a moving wall 34, a sponge seal 36, a lid section 37, a rotary gear 38, a cover 39, and a detection piece 40.

The container main body 31 is a main body portion of the toner container 30 having a cylindrical shape. The container main body 31 includes an inner peripheral section 311 and an internal space 312. The inner peripheral section 311 is an inner peripheral surface of the container main body 31 and extends in a cylindrical shape in a horizontal direction that is a longitudinal direction of the toner container 30. The internal space 312 is a space capable of housing toner. The internal space 312 is partitioned by a cylindrical barrel section 314 (a wall partitioning the internal space), a left wall 315 that seals a left end side of the barrel section 314, a flange section 316 that seals a right end side of the barrel section 314, and the lid section 37. In the internal space 312, a region defined by the left wall 315, the moving wall 34 (to be described later), and the inner peripheral section 311 constitutes a housing space 313. The housing space 313 is a space that actually houses toner inside the toner container 30.

The container main body 31 includes a shutter member 317, a first guide section 318, and the toner discharge port 319 (the developer discharge port). The shutter member 317 has a U-shape and is mounted on an outer periphery near a left end of the container main body 31 so as to be horizontally movable with respect to the container main body 31. The first guide section 318 is a protruded section extending in a vertical direction on an outer side of the left wall 315. Together with a second guide section 392 (to be described later), the first guide section 318 guides mounting of the toner container 30 to the case 101.

The toner discharge port 319 is an opening which penetrates the barrel section 314 at a lower position in a vicinity of a left end (a downstream end in a first direction) of the container main body 31 and which allows communication between the internal space 312 and the outside. The shutter member 317 is a member which changes postures between a closing posture that seals the toner discharge port 319 from an outer peripheral side of the container main body 31 and an opening posture that opens the toner discharge port 319. When the toner discharge port 319 is in an opened state, the toner housed in the housing space 313 is discharged from the toner discharge port 319 toward the developing apparatus 20 (the toner replenishing port 25).

The stirring disk 32 is a plate member with a disk shape. The stirring disk 32 is fixed to a second shaft end section 332 of the shaft 33 (to be described later) and integrally rotates with the shaft 33. The stirring disk 32 is arranged near the left wall 315 in the container main body 31 and stirs toner existing above the toner discharge port 319. Moreover, when flowability of the toner housed in the housing space 313 is low, a projecting section that protrudes to the right toward the housing space 313 may be provided on the stirring disk 32.

The shaft 33 is arranged in the internal space 312 so to extend in a horizontal direction (in the present embodiment, it is assumed that a direction from right to left is a "first direction", a right side is an "upstream side", and a left side is a "downstream side") and is rotatably supported by the container main body 31 and the lid section 37 (to be described later). The shaft 33 is rotationally driven around an axis thereof by a motor M. The shaft 33 includes a first shaft end section 331, the second shaft end section 332, a male spiral section 333, and a moving wall stopping portion 334.

The first shaft end section 331 is a right end of the shaft 33 and is pivotally supported by a lid shaft hole section 37J of the lid section 37. The second shaft end section 332 is a left end of the shaft 33 and is pivotally supported by a bearing section 31J provided on the left wall 315 of the container main body 31. The male spiral section 333 is a spiral screw section formed at a prescribed pitch on an outer peripheral surface of the shaft 33. The male spiral section 333 according to the present embodiment is formed in a region from a position opposing the flange section 316 to a position near the toner discharge port 319 of the shaft 33. The moving wall stopping portion 334 is arranged adjacent to a left end of the male spiral section 333 and is a region which is constituted only by a shaft portion and in which a protruding portion like the male spiral section 333 does not exist. The moving wall stopping portion 334 is positioned in a region above the toner discharge port 319 and in a region adjacent to the right of the toner discharge port 319.

The moving wall 34 is arranged in the internal space 312 and moves from right (an upstream side in the first direction) to left (a downstream side) along the shaft 33 in the internal space 312. The moving wall 34 is a wall that defines a right end surface of the housing space 313 in which toner is actually housed. The moving wall 34 moves inside the internal space 312 from an initial position set in advance to a final position opposing the toner discharge port 319 during a period from the start of use to the end of use of the toner container 30. In doing so, the moving wall 34 conveys the toner in the housing space 313 toward the toner discharge port 319. The moving wall 34 is engaged with the male spiral section 333 of the shaft 33 and moves in a direction of an arrow DA as the shaft 33 is rotated by driving of the motor M.

The moving wall 34 includes a wall main body section 340, a moving wall shaft hole section 34J, an outer peripheral wall section 341, an inner wall seal 342, a shaft seal 343, and an outer peripheral section 344. The wall main body section 340 is a part of a wall portion defining the housing space 313 and includes a conveyance surface 340S that is perpendicular to the shaft 33. The conveyance surface 340S is provided on a left side surface (a surface facing the downstream side) of the moving wall 34 and presses and conveys the toner in the housing space 313 as the moving wall 34 moves. A cylindrical hole which holds the shaft seal 343 and which is penetrated by the shaft 33 is formed at center of the wall main body section 340. The moving wall shaft hole section 34J is a cylindrical portion that protrudes rightward from center of a right surface of the wall main body section 340. A female spiral section 345 that engages with the male spiral section 333 of the shaft 33 is provided on an inner peripheral surface of the moving wall shaft hole section 34J.

The outer peripheral wall section 341 is a side peripheral wall of the wall main body section 340 and opposes the inner peripheral section 311 of the container main body 31 across a prescribed gap. The inner wall seal 342 is a seal member arranged so as to cover a periphery of the outer peripheral wall section 341 and is compressively deformed between the inner peripheral section 311 and the outer peripheral wall section 341. When the moving wall 34 moves in the direction of the arrow DA, the inner wall seal 342 prevents the toner in the housing space 313 from flowing toward an upstream side in the direction of movement of the moving wall 34 from between the inner peripheral section 311 and the moving wall 34.

The shaft seal 343 is arranged so as to come into contact with the male spiral section 333 of the shaft 33 and cleans toner adhered to the male spiral section 333 as the moving wall 34 moves. The shaft seal 343 is arranged on a downstream side in the direction of movement of the moving wall 34 with respect to the moving wall shaft hole section 34J. Therefore, the shaft seal 343 comes into contact with the male spiral section 333 before the female spiral section 345 and, consequently, enables the female spiral section 345 to proceed on the male spiral section 333 in a state where toner is almost completely removed from the male spiral section 333. In addition, due to the sealing function of the shaft seal 343, the toner in the housing space 313 is prevented from flowing toward an upstream side in the direction of movement through a gap between the shaft 33 and the moving wall 34.

The lid section 37 is fixed to the flange section 316 of the container main body 31 and seals an opening on a right surface of the container main body 31. The lid section 37 includes a lid shaft hole section 37J. The lid shaft hole section 37J rotatably supports a side of the first shaft end section 331 of the shaft 33. The sponge seal 36 is arranged between the moving wall shaft hole section 34J and the lid section 37. The sponge seal 36 prevents toner from leaking out from the lid shaft hole section 37J of the lid section 37 in a state where the lid section 37 is fixed to the container main body 31.

The rotary gear 38 is fixed to the first shaft end section 331 of the shaft 33 and integrally rotates with the shaft 33. The rotary gear 38 is coupled to the motor M arranged in the case 101 via a transmission gear mechanism (not shown). When a rotational driving force is input from the motor M, the rotary gear 38 transmits the rotational driving force to the shaft 33 and causes the moving wall 34 to move.

The cover 39 is a cover member to be attached to a right end surface of the container main body 31. The cover 39 covers the right end surface of the container main body 31 in a state where a part of the rotary gear 38 is exposed. The cover 39 includes a shaft cover section 391 and a second guide section 392. The shaft cover section 391 covers an end portion of the first shaft end section 331 protruding from the rotary gear 38. The second guide section 392 is a projecting section extending in a vertical direction. Due to the second guide section 392 and the first guide section 318 on a side of the left end surface of the container main body 31, the toner container 30 is guided when being mounted to the printer 100.

The detection piece 40 is a member which is mounted to the moving wall 34 and which becomes a detection object of a toner sensor 31T (to be described later). The detection piece 40 is attached to the conveyance surface 340S in a state where the detection piece 40 protrudes leftward from the conveyance surface 340S. The detection piece 40 according to the first embodiment is a member with a circular or square column shape. A base end section 401 of the detection piece 40 is fastened to the conveyance surface 340S by a method such as screwing, fitting, or adhesion, and a tip section 402 of the detection piece 40 is at position protruding more leftward than the conveyance surface 340S. The detection piece 40 is a member arranged in order to reliably identify that the moving wall 34 has reached a most downstream position in a range of movement in the horizontal direction or, in other words, that the toner in the toner container 30 is empty.

In the present embodiment, the detection piece 40 is made of a member formed by a magnetic body so as to enable sensing by the toner sensor 31T that senses toner having magnetism. While the material that forms the detection piece 40 is not limited as long as the material is a magnetic body, desirably, the material has higher permeability than the toner housed in the toner container 30. Accordingly, different sensor outputs can be obtained when both the magnetic toner and the detection piece 40 are magnetically sensed and the magnetic toner and the detection piece 40 can be identified.

The toner sensor 31T is annexed to the toner container 30. The toner sensor 31T is attached to an outer wall surface in a vicinity of the toner discharge port 319 of the container main body 31. The toner sensor 31T is a sensor that detects magnetism of a detection object or, more specifically, a sensor which detects permeability (an example of a physical quantity) of a detection object and which generates an electrical output. In other words, the toner sensor 31T is a sensor capable of detecting a common physical quantity between the magnetic toner and the detection piece 40 made of a magnetic body. Accordingly, the sensor originally installed in order to detect toner can also be used to detect the detection piece 40 and reductions in the number of parts as well as cost can be achieved. A favorable example of the toner sensor 31T is a magnetic bridge-type permeability sensor using a differential transformer. Moreover, the toner sensor 31T need not necessarily be attached to a wall surface of the container main body 31 and may be arranged at, for example, an appropriate location in the container housing section 109 of the case 101.

Figure 7A:
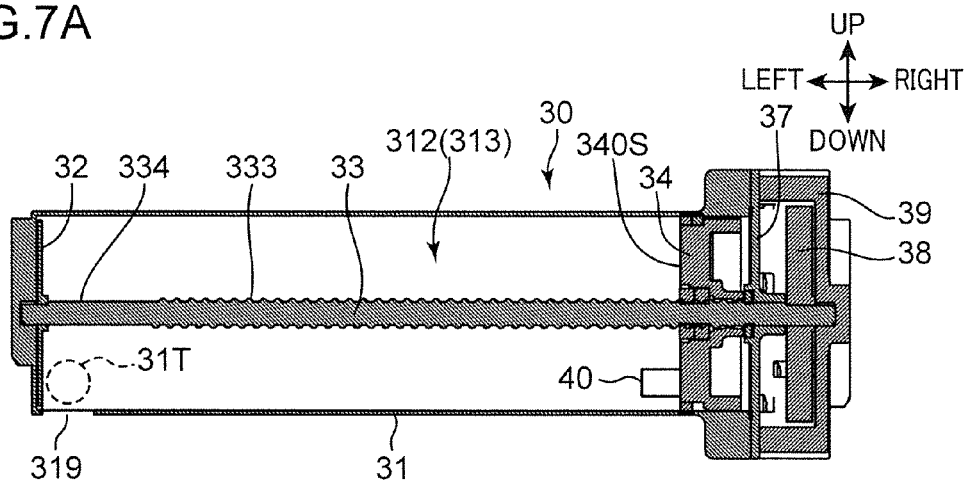
FIGS. 7A, 7B, and 7C are sectional views showing how a moving wall moves in a container main body.
Figure 7B:
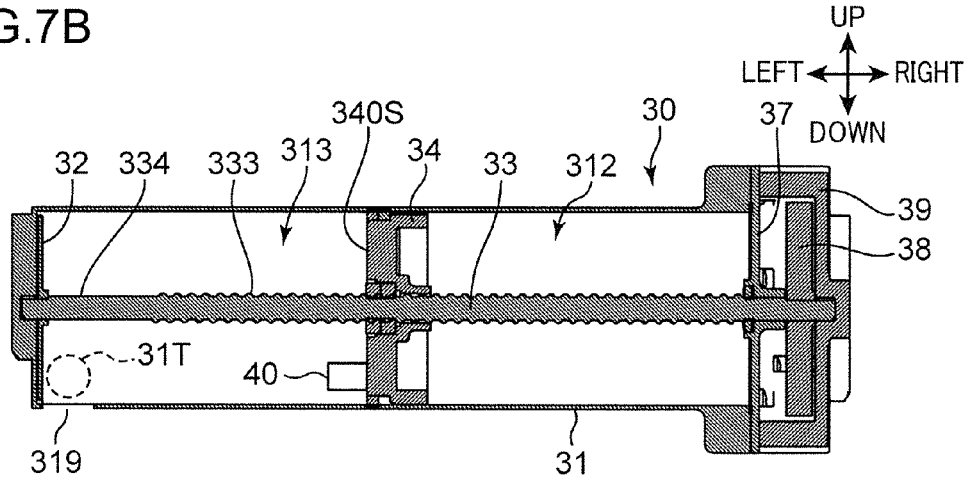
Figure 7C:
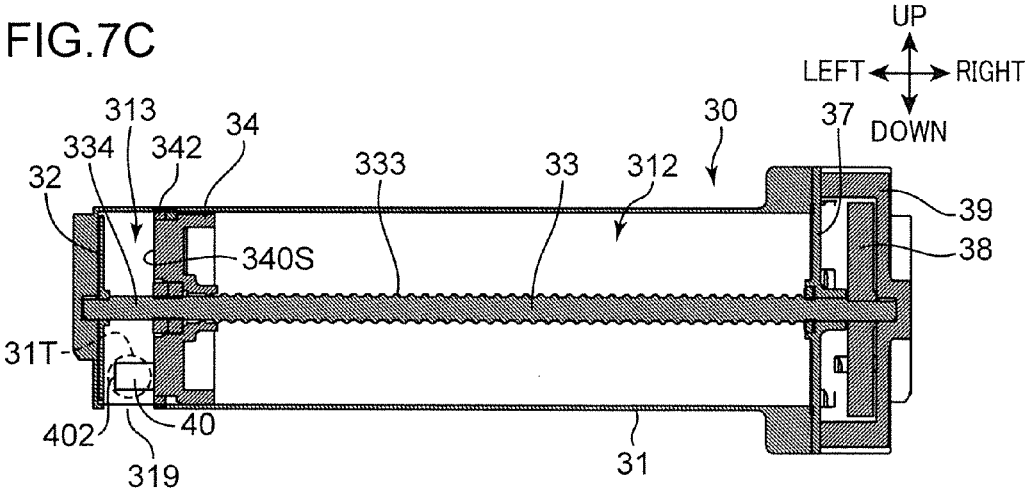

FIGS. 7A to 7C are sectional views showing how the moving wall 34 moves in the container main body 31, wherein FIG. 7A shows a state where the moving wall 34 is at an initial position (a most upstream position), FIG. 7B shows a state where the moving wall 34 has been moved about halfway to the left from the initial position, and FIG. 7C shows a state where the moving wall 34 is at a final position (a most downstream position) that is proximal to the toner discharge port 319. Depiction of the shutter member 317 has been omitted in these drawings.

The state shown in FIG. 7A is a state where the housing space 313 that houses toner is most spacious and the internal space 312 of the container main body 31 is almost entirely occupied by the housing space 313. This state is a state where a full amount of toner is housed and a state prior to use of the toner container 30. At this point, the moving wall 34 is at a position adjacent to the lid section 37. The detection piece 40 is at a position that is most separated from the toner sensor 31T.

FIG. 7B shows a state where about half of the toner has been consumed. As toner is consumed, the moving wall 34 moves leftward (in a first direction) from the initial position shown in FIG. 7A. Capacity of the housing space 313 has decreased to around half of the internal space 312. At this point, the conveyance surface 340S of the wall main body section 340 pushes the toner in the housing space 313 to convey the toner toward the toner discharge port 319. Moreover, a mode of movement of the moving wall 34 is not particularly limited. For example, the moving wall 34 can be successively moved at a fine pitch as toner decreases. Alternatively, the shaft 33 may be roughly divided in a longitudinal direction into three to six sections and the moving wall 34 may be moved in units of the sections as toner decreases.

FIG. 7C shows a state (empty) where the toner in the container has substantially been used up. The moving wall 34 has moved to near a left end of the shaft 33 (a vicinity of the toner discharge port 319) and the housing space 313 is extremely narrow. As a result, compared to a toner container in which a capacity of a housing space does not change, the amount of toner remaining in the housing space 313 of the container main body 31 at the end of use is reduced. In the state shown in FIG. 7C, the moving wall shaft hole section 34J of the moving wall 34 reaches the moving wall stopping portion 334. Therefore, a leftward propulsive force is no longer applied to the moving wall 34. In addition, at the final position, positions of the detection piece 40 and the toner sensor 31T in the horizontal direction overlap each other. The tip section 402 of the detection piece 40 is adjacent to the right surface of the stirring disk 32. In other words, the toner sensor 31T is arranged at a position where the detection piece 40 can be detected when the moving wall 34 is closest to the toner discharge port 319.

[Developer Replenishing Apparatus According to First Embodiment]

Figure 8:
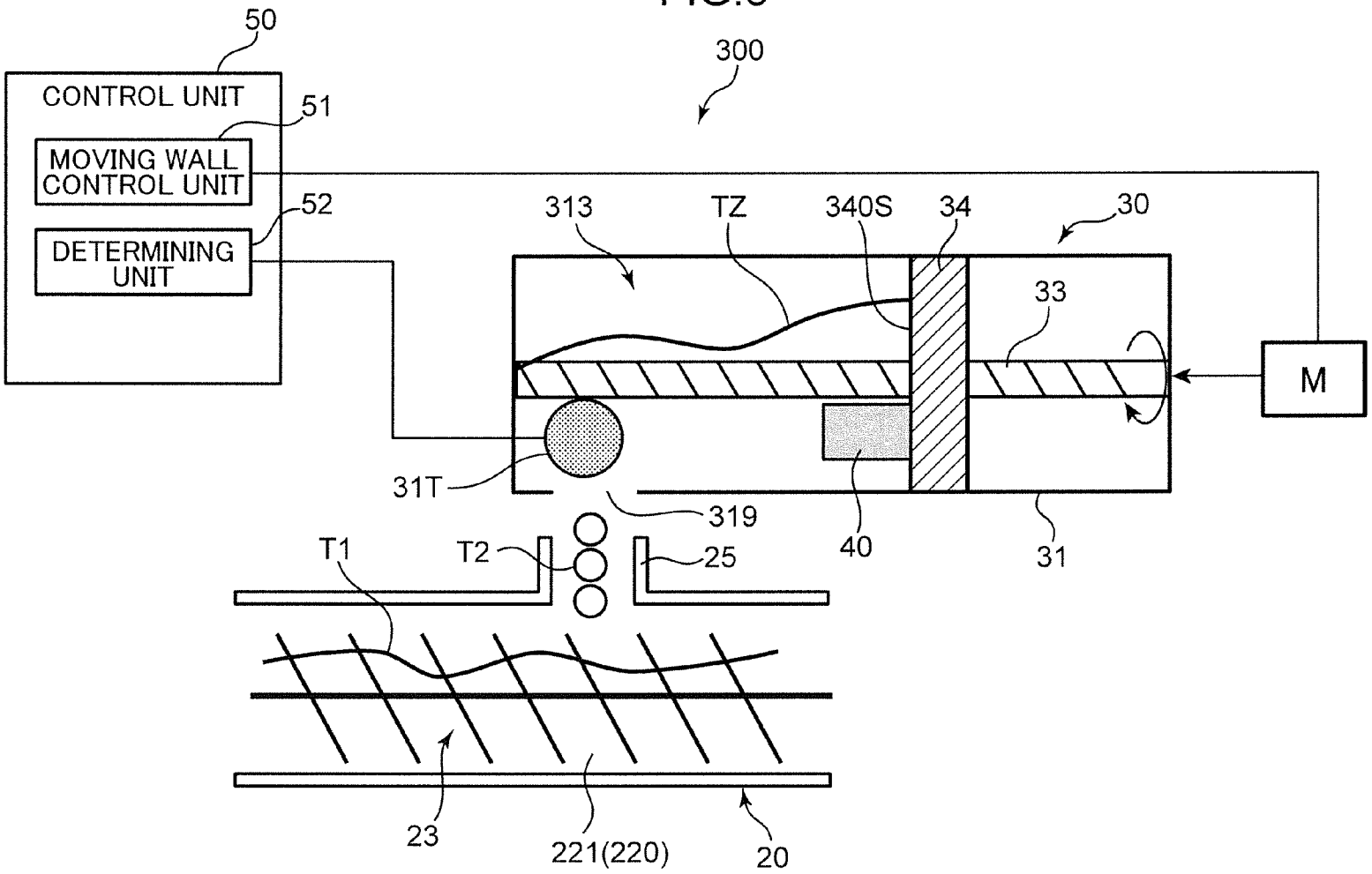
FIG. 8 is a block diagram schematically showing a configuration of a developer replenishing apparatus according to the first embodiment.

FIG. 8 is a block diagram schematically showing a configuration of a toner replenishing apparatus 300 (a developer replenishing apparatus) according to the first embodiment. The toner replenishing apparatus 300 is an apparatus for replenishing toner to the developing apparatus 20 and includes the toner container 30 and the toner sensor 31T described above, the motor M, and a control unit 50.

The motor M is a drive source that moves the moving wall 34 via the shaft 33. An output shaft of the motor M is coupled via a transmission gear mechanism (not shown) to the rotary gear 38 (FIG. 6) connected to the shaft 33.

The control unit 50 is constituted by a microcomputer and controls operations of the toner replenishing apparatus 300 as a prescribed program is executed. The control unit 50 functionally includes a moving wall control unit 51 (control unit) and a determining unit 52. The moving wall control unit 51 controls movements of the moving wall 34. Specifically, the moving wall control unit 51 operates the motor M under predetermined conditions to rotate the shaft 33 and controls movement positions of the moving wall 34 on the shaft 33. The determining unit 52 determines a presence or absence of toner in the toner container 30 based on output of the toner sensor 31T.

Figure 18:
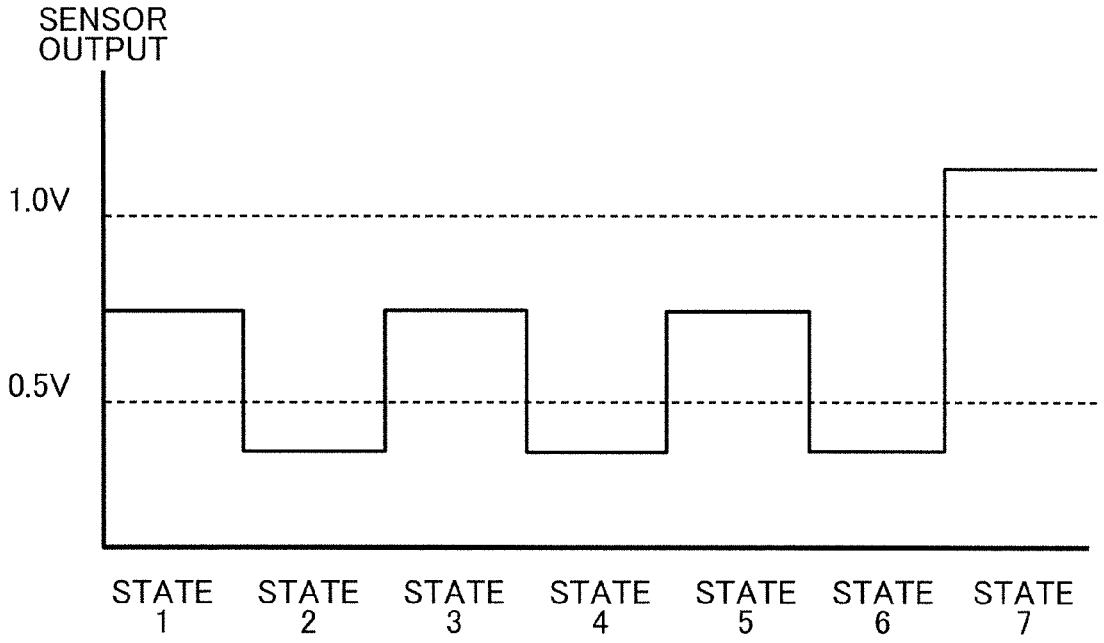
FIG. 18 is a graph showing a sensor output in each of the states of movement of a moving wall shown in FIGS. 16 and 17.

The toner sensor 31T generates respectively different sensor outputs for a case where toner with magnetism (replenishing toner TZ) exists in a detection area of the toner sensor 31T, a case where toner does not exist in the detection area, and a case where the detection piece 40 exists in the detection area. The toner sensor 31T according to the present embodiment respectively generates sensor outputs of a prescribed voltage V1 (a first value) when toner is detected, a lower voltage V2 (a third value) that is lower than V1 when toner is not detected, and V3 (a second value) that is higher than V1 when the detection piece 40 is detected. As illustrated in FIG. 18 (to be described later), for example, V1=0.75 V, V2=0.35 V, and V3=1.2 V can be set. In this case, for example, by setting a detection threshold to near 1.0 V, even when the toner sensor 31T is used for both detection of the replenishing toner TZ and detection of the detection piece 40, the replenishing toner TZ and the detection piece 40 can be distinguished from each other.

In the present embodiment, the determining unit 52 receives sensor outputs such as described above of the toner sensor 31T and identifies a housing state of toner in the toner container 30. When the toner sensor 31T is outputting V1, the determining unit 52 determines a state where the replenishing toner TZ sufficiently exists in a vicinity of the toner discharge port 319 (FIG. 8 shows this state). The state in this case is a state where toner T2 can be discharged from the toner discharge port 319 to the developing apparatus 20 through the toner replenishing port 25. Therefore, when the determining unit 52 is performing the determination described above, the moving wall control unit 51 temporarily renders the moving wall 34 in a stopped state.

On the other hand, when the toner sensor 31T is outputting V2, the determining unit 52 determines a state where the replenishing toner TZ does not sufficiently exist in the vicinity of the toner discharge port 319. In this case, a state exists where sufficient toner T2 cannot be discharged from the toner discharge port 319. This is a state where discharge of toner T2 has proceeded from the state shown in FIG. 8 and the replenishing toner TZ that had existed around the toner discharge port 319 has been consumed. When this state is determined, the moving wall control unit 51 drives the motor M and moves the moving wall 34 leftward (toward the downstream side) by a prescribed distance. Accordingly, the replenishing toner TZ in the container main body 31 (the housing space 313) is pressed by the conveyance surface 340S of the moving wall 34 and is conveyed leftward. Subsequently, the periphery of the toner discharge port 319 is once again filled with replenishing toner.

When the toner sensor 31T generates an output of V3 (an output determined in advance which indicates that the detection piece has been detected), the determining unit 52 determines a state where there is no toner in the toner container 30. A position of the moving wall 34 at which the detection piece 40 starts to be detected by the toner sensor 31T is a final position at a left end. At this point, the housing space 313 is smallest and a state is created where the replenishing toner TZ hardly exists in the container main body 31. In other words, the determining unit 52 determines whether or not the moving wall 34 has reached the final position based on whether or not the detection piece 40 has been detected by the toner sensor 31T, and when it is identified that the moving wall 34 is at the final position, the determining unit 52 determines that the toner container 30 is in a toner empty state.

After V3 is output, the moving wall control unit 51 permanently renders the moving wall 34 in a stopped state. This is because the state where the toner sensor 31T outputs V3 does not indicate that a state is reached where toner is absent only around the toner discharge port 319 but indicates that a state is reached where the replenishing toner TZ is approximately absent inside the container main body 31. Another reason is that, since the moving wall 34 interferes with the container main body 31, a state is reached where the moving wall 34 cannot move further to the left. Moreover, in a toner replenishing apparatus according to a comparative example in which the detection piece 40 is not present, whether there is a state where toner still remains in the container main body 31 and the moving wall 34 may be moved or a state where toner is empty in the container main body 31 cannot be definitely determined based on output of the toner sensor 31T.

Figure 9A:
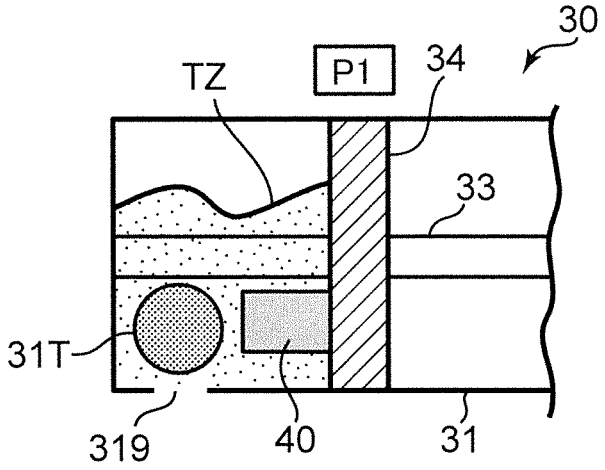
FIGS. 9A, 9B, and 9C are sectional views showing how a moving wall including a detection piece according to the first embodiment moves.
Figure 9B:
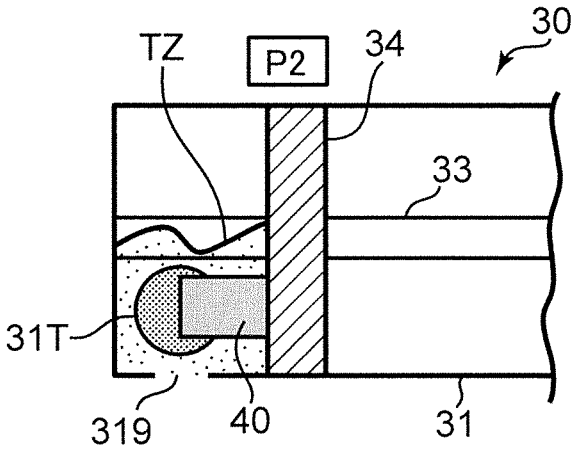
Figure 9C:
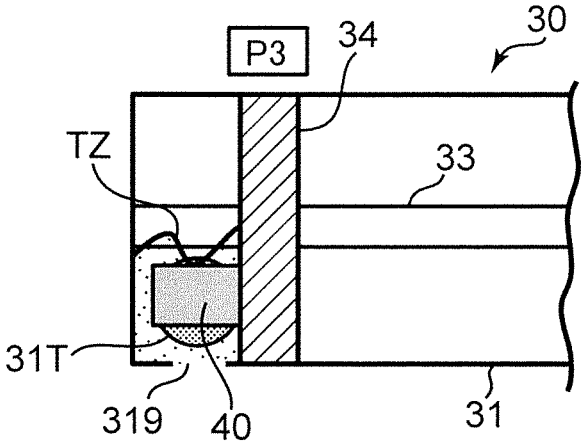

FIGS. 9A to 9C are sectional views showing how the moving wall 34 provided with the detection piece 40 according to the first embodiment moves toward an arrangement position of the toner sensor 31T. FIG. 9A shows a state where the moving wall 34 exists at position P1 at which the detection piece 40 has not yet entered a detection area of the toner sensor 31T. FIG. 9B shows a state where the moving wall 34 exists at position P2 at which a part of a tip side of the detection piece 40 has entered the detection area. FIG. 9C shows a state where the moving wall 34 exists at position P3 at which all of the detection piece 40 has entered the detection area. The state at position P3 is a state where the replenishing toner TZ in the toner container 30 is substantially empty.

Figure 10A:
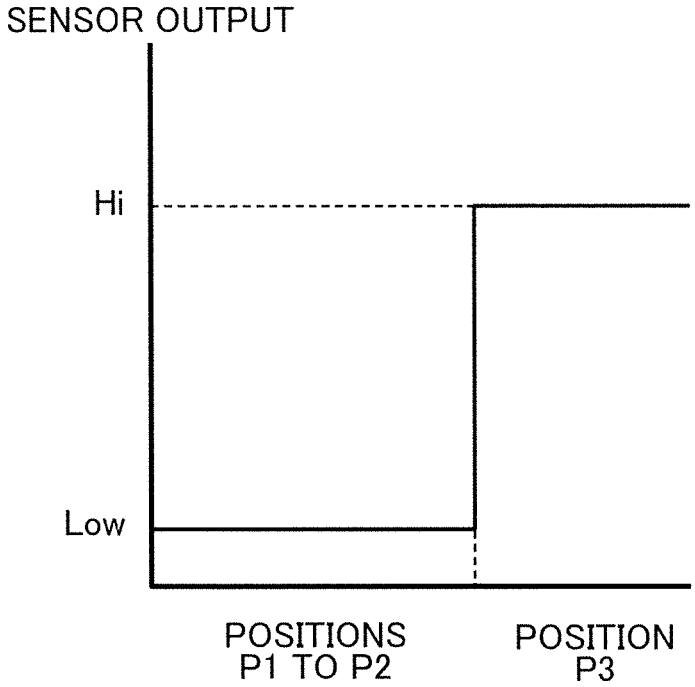
FIGS. 10A and 10B are graphs showing sensor outputs according to the first embodiment.
Figure 10B:
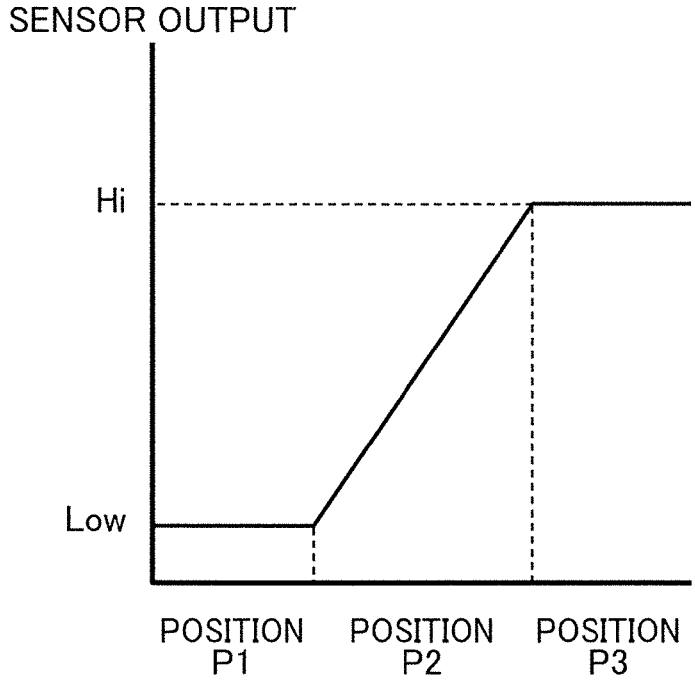

FIGS. 10A and 10B are graphs showing examples of output of the toner sensor 31T in the states at the positions P1 to P3 described above. In this case, an amount of detected toner will not be considered. FIG. 10A shows a sensor output in a case where a digital output-type sensor is used as the toner sensor 31T. The toner sensor 31T is provided with a prescribed threshold and outputs a Low signal when equal to or lower than the threshold and outputs a Hi signal when higher than the threshold. In this case, when the moving wall 34 exists at the positions P1 and P2, the sensor output is Low and, when the moving wall 34 exists at position P3, the sensor output is a Hi signal. The threshold is set so that such outputs can be obtained. According to this output example, a determination that the moving wall 34 has reached the final position can be made when a Hi signal is obtained.

FIG. 10B shows a sensor output in a case where an analog output-type sensor is used as the toner sensor 31T. In a similar manner to the output example shown in FIG. 10A, sensor output is Low when the moving wall 34 exists at position P1 and sensor output is a Hi signal when the moving wall 34 exists at position P3. On the other hand, at intermediate positions including position P2 which range from start of entry of a part of the detection piece 40 in the detection area to the moving wall 34 reaching the final position, sensor output gradually increases. According to this output example, a determination that the moving wall 34 has reached the final position can be made when a Hi signal is obtained, while a position of the moving wall 34 can be monitored in accordance with a magnitude of an output value when the moving wall 34 is at the intermediate positions. Due to the monitoring, a so-called near end state where toner hardly remains in the toner container 30 can be detected.

Modification 1 of First Embodiment

Figure 11A:
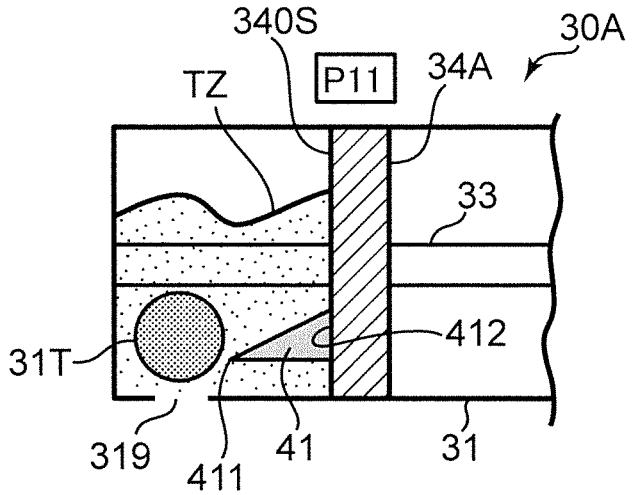
FIGS. 11A, 11B, and 11C are sectional views showing how a moving wall including a detection piece according to modification 1 of the first embodiment moves.
Figure 11B:
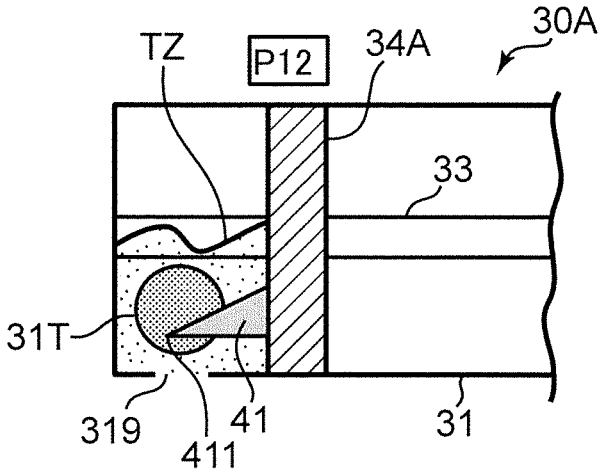
Figure 11C:
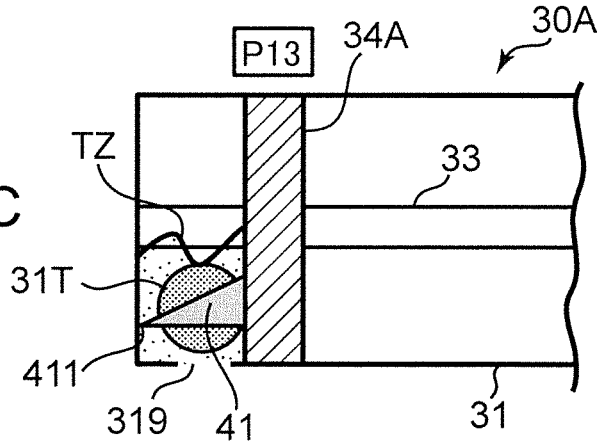

FIGS. 11A to 11C are sectional views showing, in a toner container 30A equipped with a moving wall 34A mounted with a detection piece 41 according to modification 1 of the first embodiment, how the moving wall 34A moves toward an arrangement position of the toner sensor 31T. The detection piece 41 has a shape with different areas per unit length in a side view in the horizontal direction. Specifically, the detection piece 41 includes a sharp tip section 411 and a wide base end section 412 and has a right triangle shape in a side view (a sectional shape in a depth direction is constant). The base end section 412 is attached to the conveyance surface 340S of the moving wall 34A and a side of the tip section 411 protrudes leftward from the conveyance surface 340S.

FIG. 11A shows a state where the moving wall 34A exists at position P11 immediately prior to the tip section 411 of the detection piece 41 entering the detection area of the toner sensor 31T. FIG. 11B shows a state where the moving wall 34A exists at position P12 at which a part of the detection piece 41 including the tip section 411 has entered the detection area. FIG. 11C shows a state where the moving wall 34A exists at position P13 at which approximately all of the detection piece 41 has entered the detection area. The state at position P13 is a state where the moving wall 34A has proceeded to the final position and a state where the replenishing toner TZ in the toner container 30A is substantially empty.

Figure 12:
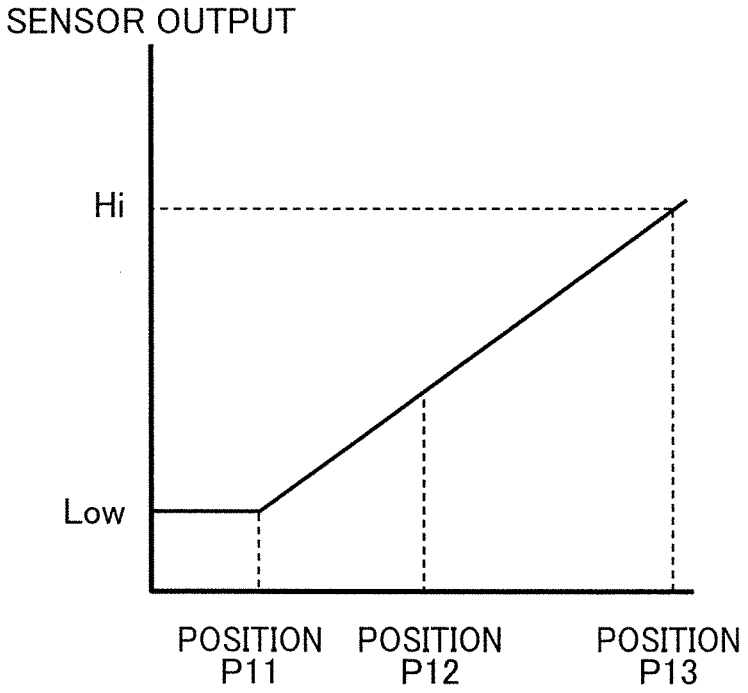
FIG. 12 is a graph showing a sensor output according to modification 1.

FIG. 12 is a graph showing an example of outputs of the toner sensor 31T in the states at the positions P11 to P13 described above. In this case, an amount of detected toner will not be considered. The graph in FIG. 12 shows sensor outputs in a case where an analog output-type sensor is used as the toner sensor 31T. Moreover, in a case of a digital output-type toner sensor, outputs are substantially the same as shown in the graph in FIG. 10A.

As shown in FIG. 12, the sensor output is Low when the moving wall 34A exists at position P11 and, subsequently, output gradually increases. At position P12, the sensor output is about halfway between Hi and Low. In addition, the sensor output becomes a Hi signal when the moving wall 34A exists at position P13. Due to the detection piece 41 according to modification 1, since the shape of the detection piece 41 differs in the horizontal direction, sensor output can also change in accordance with the shape. Therefore, a position of the moving wall 34A on the shaft 33 can be determined with higher resolution.

Modification 2 of First Embodiment

FIGS. 13A to 13D are sectional views showing, in a toner container 30B equipped with a moving wall 34B mounted with a detection piece 42 according to modification 2 of the first embodiment, how the moving wall 34B moves toward an arrangement position of the toner sensor 31T. The detection piece 42 also has a shape with different areas per unit length in a side view in the horizontal direction. However, unlike modification 1, a shape with different areas is constructed by adopting a shape in which the detection piece 42 is split in the horizontal direction.

The detection piece 42 includes, in a horizontal direction, a downstream side first detection region 421, an upstream side second detection region 422, and a non-detection region 423 arranged between the first detection region 421 and the second detection region 422. The first detection region 421 and the second detection region 422 are portions formed of a magnetic body and the non-detection region 423 is a portion formed of a nonmagnetic body or, in other words, a portion that does not become a detection object of the toner sensor 31T. A right end surface of the second detection region 422 is attached to the conveyance surface 340S of the moving wall 34B and a side of the first detection region 421 protrudes leftward from the conveyance surface 340S.

Figure 13A:
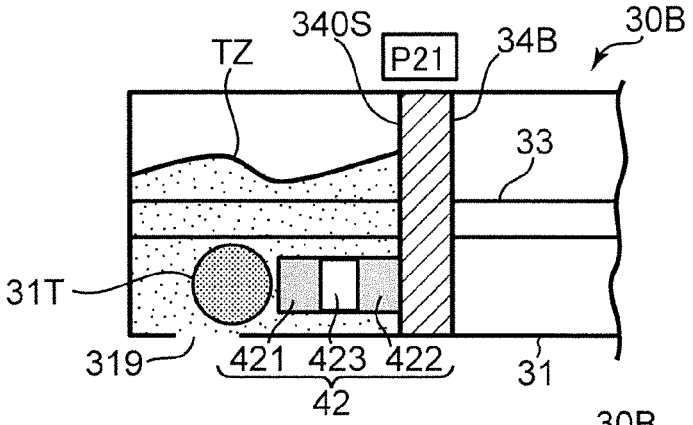
FIGS. 13A, 13B, 13C, and 13D are sectional views showing how a moving wall including a detection piece according to modification 2 of the first embodiment moves.
Figure 13B:
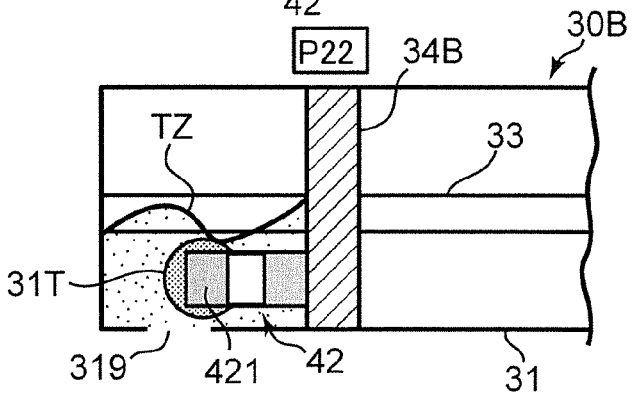
Figure 13C:
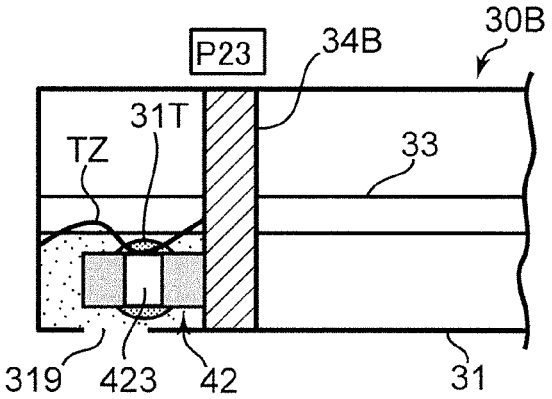
Figure 13D:
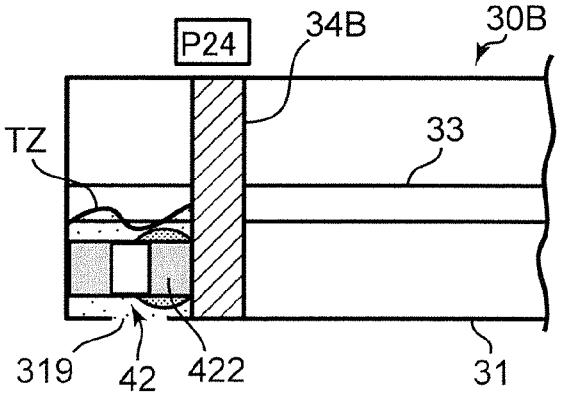

FIG. 13A shows a state where the moving wall 34B exists at position P21 at which the detection piece 42 has not yet entered a detection area of the toner sensor 31T. FIG. 13B shows a state where the moving wall 34B exists at position P22 at which the first detection region 421 of the detection piece 42 has entered the detection area. FIG. 13C shows a state where the moving wall 34B exists at position P23 at which the non-detection region 423 has entered the detection area, and FIG. 13D shows a state where the moving wall 34B exists at position P24 at which the second detection region 422 has entered the detection area. The state at position P24 is a state where the moving wall 34B has proceeded to the final position and a state where the replenishing toner TZ in the toner container 30B is substantially empty.

Figure 14:
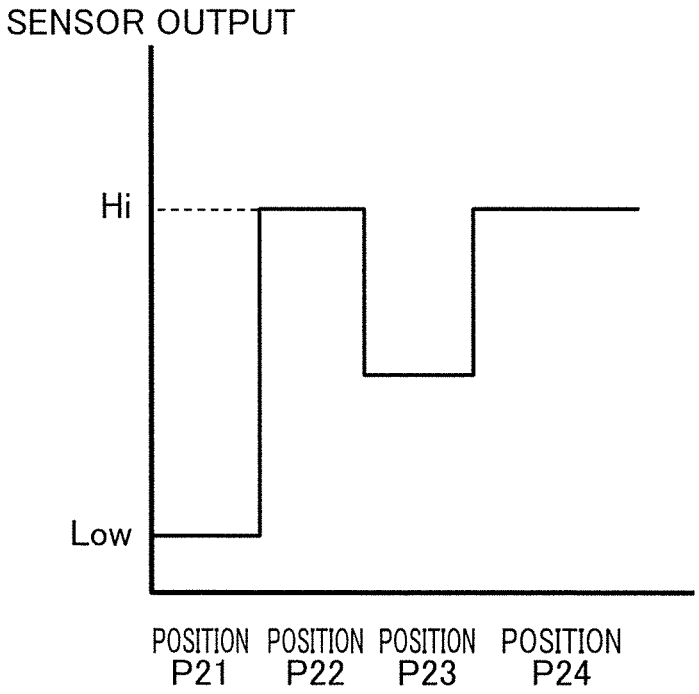
FIG. 14 is a graph showing a sensor output according to modification 2.

FIG. 14 is a graph showing an example of outputs of the toner sensor 31T in the states at the positions P21 to P24 described above. When the moving wall 34B is at position P21, the sensor output is Low. On the other hand, at position P22 or P24 at which the first detection region 421 or the second detection region 422 opposes the toner sensor 31T, the sensor output is Hi. Meanwhile, at position P23 at which the non-detection region 423 opposes the toner sensor 31T, depending on a horizontal length of the non-detection region 423, the sensor output is around halfway between Hi and Low. Moreover, when the horizontal length of the non-detection region 423 is set longer than a horizontal width of the detection area of the toner sensor 31T, it becomes difficult to distinguish between sensor outputs at the positions P21 and P23. For this reason, the horizontal length of the non-detection region 423 is desirably set to a length that does not cover the entire horizontal width of the detection area of the toner sensor 31T.

With the detection piece 43 according to modification 2, since the non-detection region 423 is arranged between the first detection region 421 and the second detection region 422, a clear difference is created in outputs of the toner sensor 31T in accordance with movement of the moving wall 34B. In other words, a valley in output characteristics is created at position P23 slightly before the moving wall 34B reaches the final position (position P24). Therefore, by detecting this valley, a near-end state can be clearly identified.

Operation Example of First Embodiment

Figure 15:
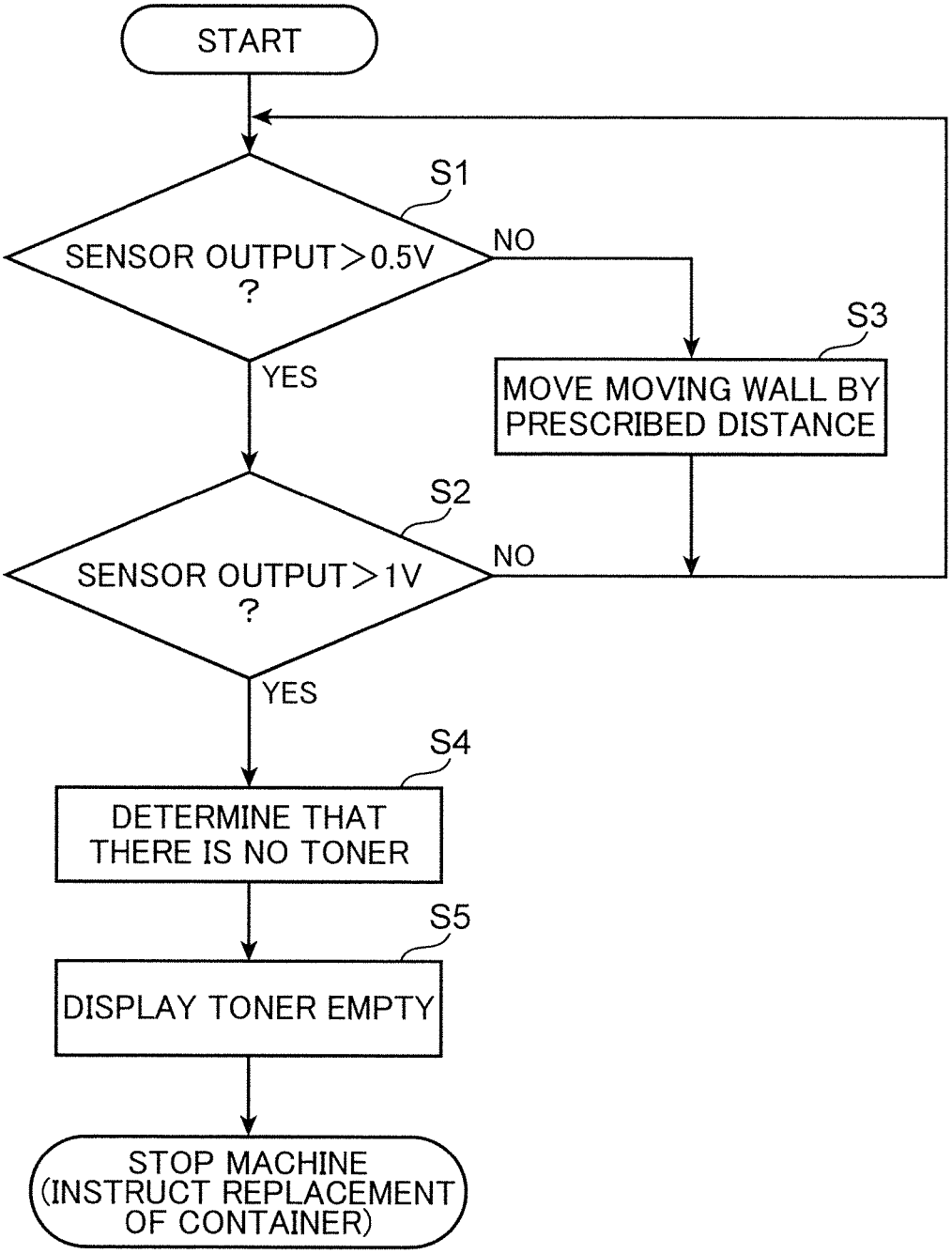
FIG. 15 is a flow chart showing operations of a developer replenishing apparatus according to the first embodiment.

Next, operations of the toner replenishing apparatus 300 in a case where the toner container 30 according to the first embodiment is used will be described. FIG. 15 is a flow chart showing a process of the control unit 50. FIGS. 16A to 16D and FIGS. 17A to 17C are schematic sectional views respectively showing a state of movement of the moving wall 34 and a state of the replenishing toner TZ. In this case, as exemplified earlier, it is assumed that the toner sensor 31T respectively generates sensor outputs of a voltage V1=0.75 V (a first value) when toner is detected, a voltage V2=0.35 V (a third value) when toner is not detected, and a voltage V3=1.2 V (a second value) when the detection piece 40 is detected. Moreover, it is assumed that a first threshold for determining the presence or absence of toner is set to 0.5 V and a second threshold for determining the presence or absence of the detection piece 40 is set to 1.0 V.

Figure 16A:
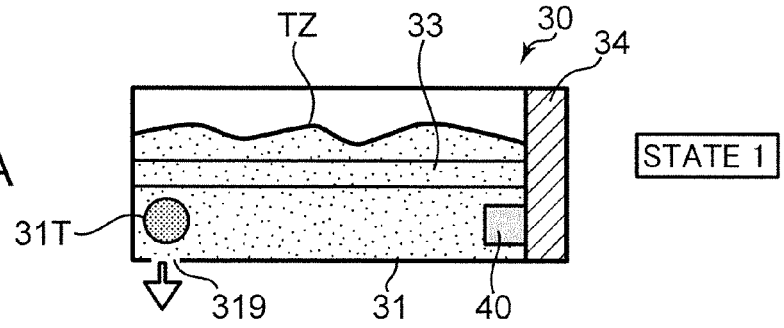
FIGS. 16A, 16B, 16C, and 16D are sectional views showing states of movement of a moving wall.

The process of the control unit 50 (FIG. 8) is triggered by the toner container 30 housing a full amount of the replenishing toner TZ being set in the internal space 107 (FIG. 2) of the case 101. FIG. 16A shows the toner container 30 at "state 1" immediately after being set in the internal space 107. The moving wall 34 is positioned at the right end of the shaft 33. It is needless to say that the periphery of the toner discharge port 319 is filled with the replenishing toner TZ.

The determining unit 52 of the control unit 50 acquires a sensor output from the toner sensor 31T at each prescribed sampling period. At each sampling period, the determining unit 52 determines whether or not the sensor output exceeds 0.5 V that is the first threshold (step S1). Since the sensor output=0.75 V when toner sufficiently exists in the detection area of the toner sensor 31T, a YES determination is made in step S1. In "state 1" described above, a YES determination is made. On the other hand, since the sensor output=0.35 V when toner does not exist, a NO determination is made in step S1.

When the sensor output exceeds 0.5 V (YES in step S1), the determining unit 52 subsequently determines whether or not the sensor output exceeds 1.0 V that is the second threshold (step S2). Since the sensor output=1.2 V in a state where the toner sensor 31T is detecting the detection piece 40, a YES determination is made in step S2. In other states, a NO determination is made in step S2 and a NO determination is also made in "state 1" described earlier.

Figure 16B:
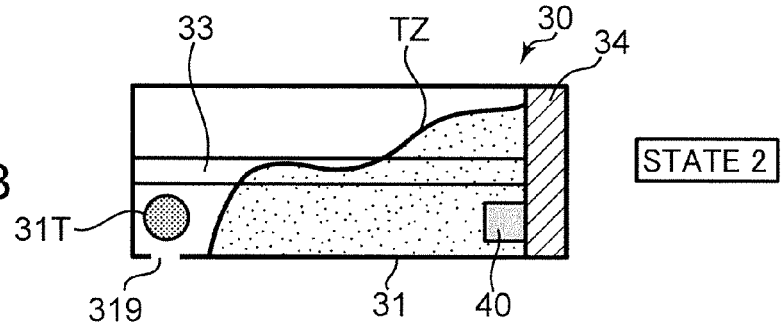
Figure 16C:
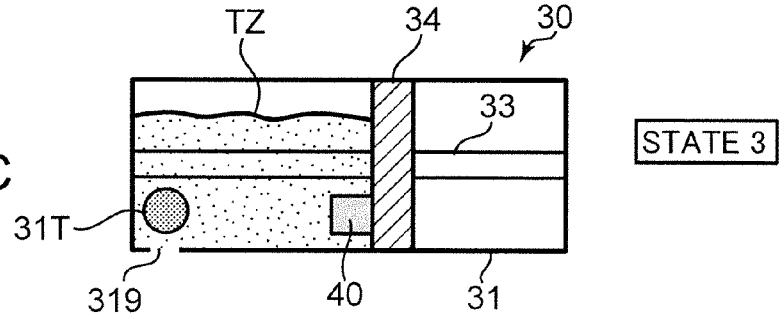

FIG. 16B shows "state 2" where supply of the replenishing toner TZ to the developing apparatus 20 has proceeded from "state 1" and the replenishing toner TZ around the toner discharge port 319 has decreased. In this case, a NO determination is made in step S1. Accordingly, the moving wall control unit 51 drives the motor M to rotate the shaft 33 by an amount of rotation determined in advance and moves the moving wall 34 leftward by a prescribed distance (step S3). FIG. 16C shows "state 3" after the moving wall 34 has been moved by the prescribed distance. Due to the movement of the moving wall 34, the replenishing toner TZ is pushed leftward and the periphery of the toner discharge port 319 is restored to a toner rich state. Therefore, when "state 3" is reached, a YES determination is made in step S1.

Figure 16D:
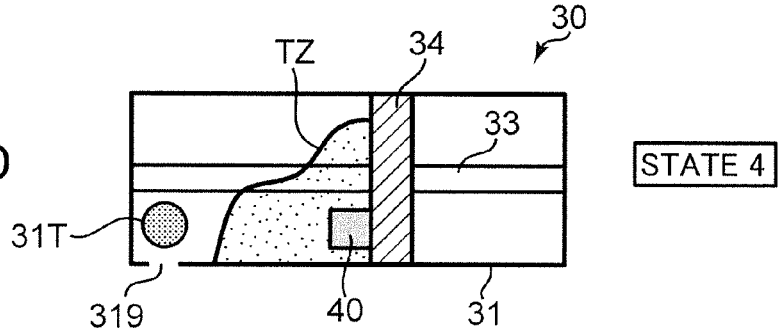
Figure 17A:
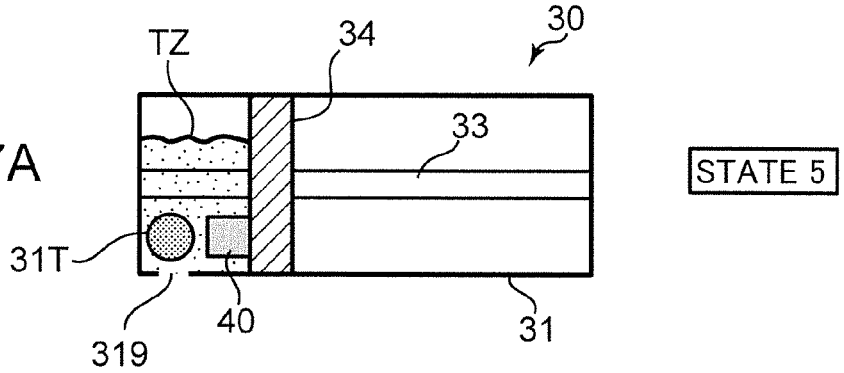
FIGS. 17A, 17B, and 17C are sectional views showing states of movement of a moving wall.

FIG. 16D shows "state 4" where supply of the replenishing toner TZ to the developing apparatus 20 has proceeded from "state 3" and the replenishing toner TZ around the toner discharge port 319 has decreased once again. When "state 4" is reached, step S1 once again returns to a NO determination. Therefore, the moving wall 34 is further moved leftward by a prescribed distance by the moving wall control unit 51 (step S3). FIG. 17A shows "state 5" after the moving wall 34 has been further moved by the prescribed distance. In "state 5", the periphery of the toner discharge port 319 is restored to a toner rich state and a YES determination is made in step S1.

Figure 17B:
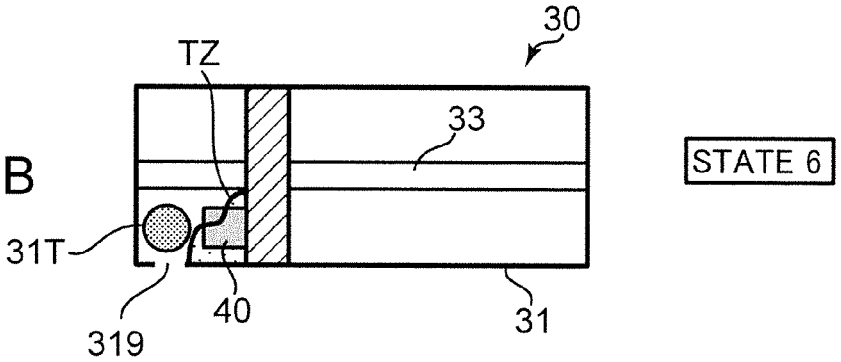
Figure 17C:
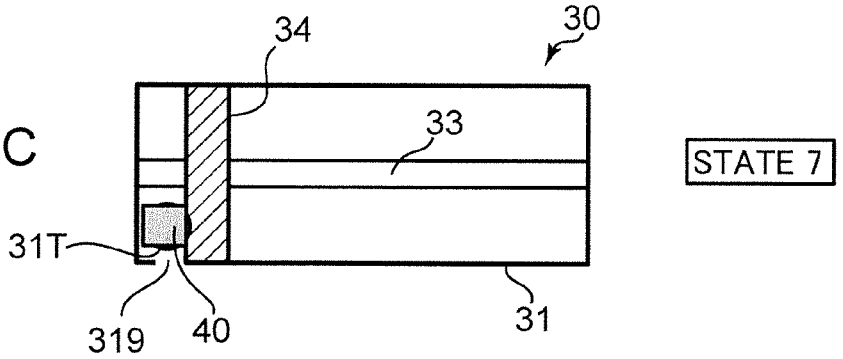

FIG. 17B shows "state 6" where supply of the replenishing toner TZ to the developing apparatus 20 has proceeded from "state 5" and the replenishing toner TZ around the toner discharge port 319 has decreased once again. Since a NO determination is made once again in step S1 when "state 6" is reached, the moving wall control unit 51 further moves the moving wall 34 leftward by a prescribed distance. Accordingly, as shown in FIG. 17C, "state 7" is reached where the moving wall 34 moves to a final position. In "state 7", the replenishing toner TZ hardly remains in the container main body 31. Moreover, while an example has been shown in which the moving wall 34 is moved leftward in units of an approximately ⅓ length of the shaft 33, alternatively, the moving wall 34 may be moved in finer units.

In "state 7", the detection piece 40 enters the detection area of the toner sensor 31T. Therefore, a YES determination is made in step S2. In this case, the determining unit 52 determines that the inside of the toner container 30 is in a "no toner" state (step S4). In addition, using a display panel, a display lamp, or the like (not shown) provided on the printer 100, the control unit 50 displays that the current state is a toner empty state to a user (step S5). Subsequently, the control unit 50 stops the operation of the printer 100.

FIG. 18 is a graph showing respective sensor outputs in "state 1" to "state 7" described above. From "state 1" to "state 6", the sensor output repetitively exceeds and falls under 0.5 V that is the first threshold but never exceeds 1.0 V that is the second threshold. During this period, the moving wall 34 is temporarily stopped in "state 1", "state 3", and "state 5" where the sensor output exceeds 0.5 V and the moving wall 34 is moved toward the downstream side by a prescribed distance (a distance corresponding to approximately ⅓ of the length of the shaft 33) in "state 2", "state 4", and "state 6" where the sensor output falls below 0.5 V. Therefore, a state where the periphery of the toner discharge port 319 is filled with toner can be created in a timely manner.

On the other hand, when a transition is made from "state 6" to "state 7", the sensor output exceeds 1.0 V that is the second threshold. This means that the toner sensor 31T has detected that the moving wall 34 has reached the final position near the toner discharge port 319. The existence of the moving wall 34 at the final position means that the toner in the toner container 30 is in an empty state. Therefore, with the toner replenishing apparatus 300 according to the present embodiment, the fact that a toner empty state is created can be reliably determined based on an output of the toner sensor 31T. When the detection piece 40 is not provided on the moving wall 34, the sensor output at "state 7" is either 0.75 V or 0.35 V if no toner remains and is indistinguishable from "state 1" to "state 6". In contrast, in the present embodiment, since the presence of the detection piece 40 enables a sensor output=1.2 V to be obtained in "state 7", the sensor output can be clearly distinguished from those in "state 1" to "state 6".

[Developer Housing Container According to Second Embodiment]

Figure 19:
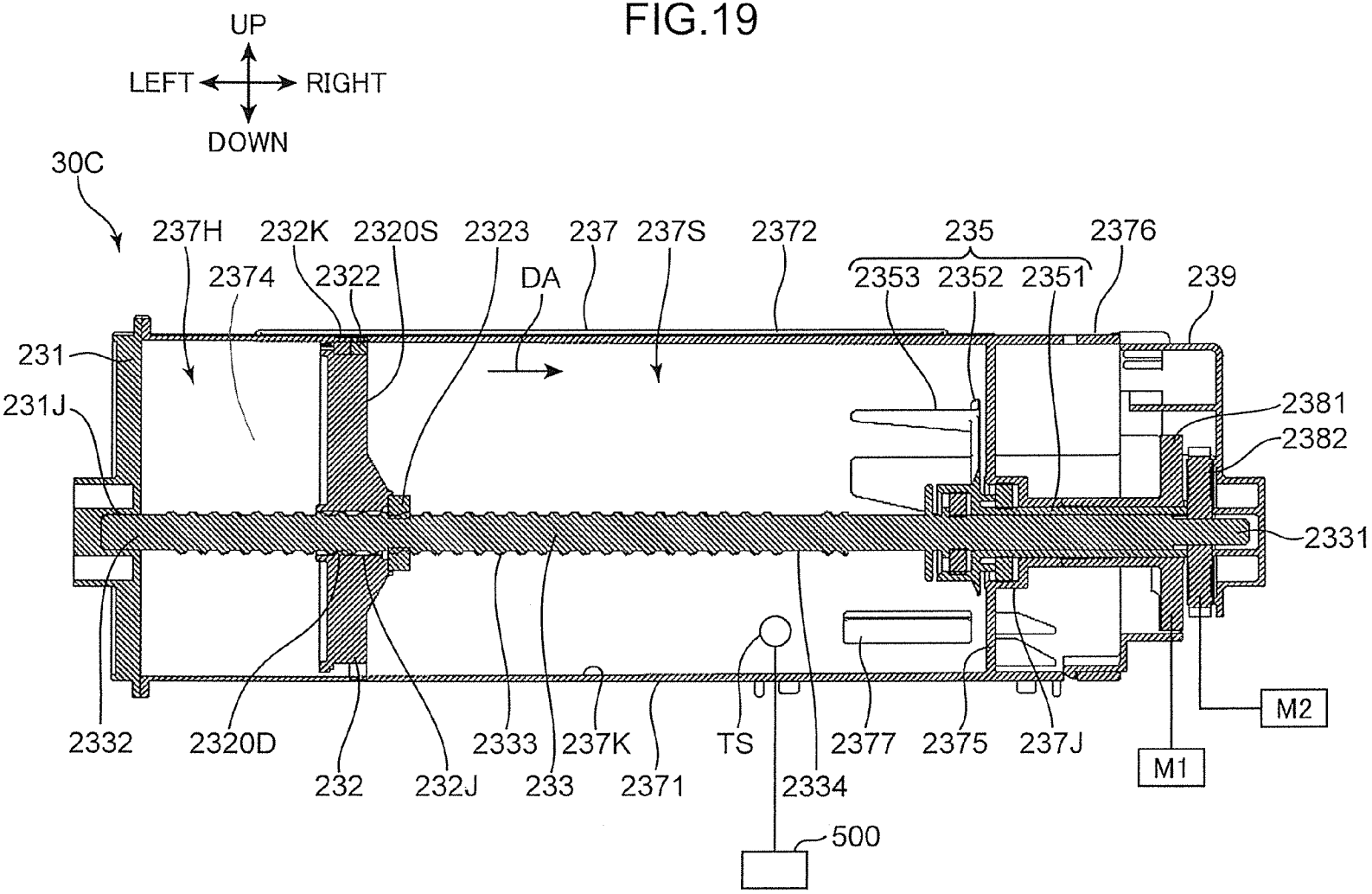
FIG. 19 is a sectional view in a horizontal direction of a developer housing container according to a second embodiment.
Figure 20:
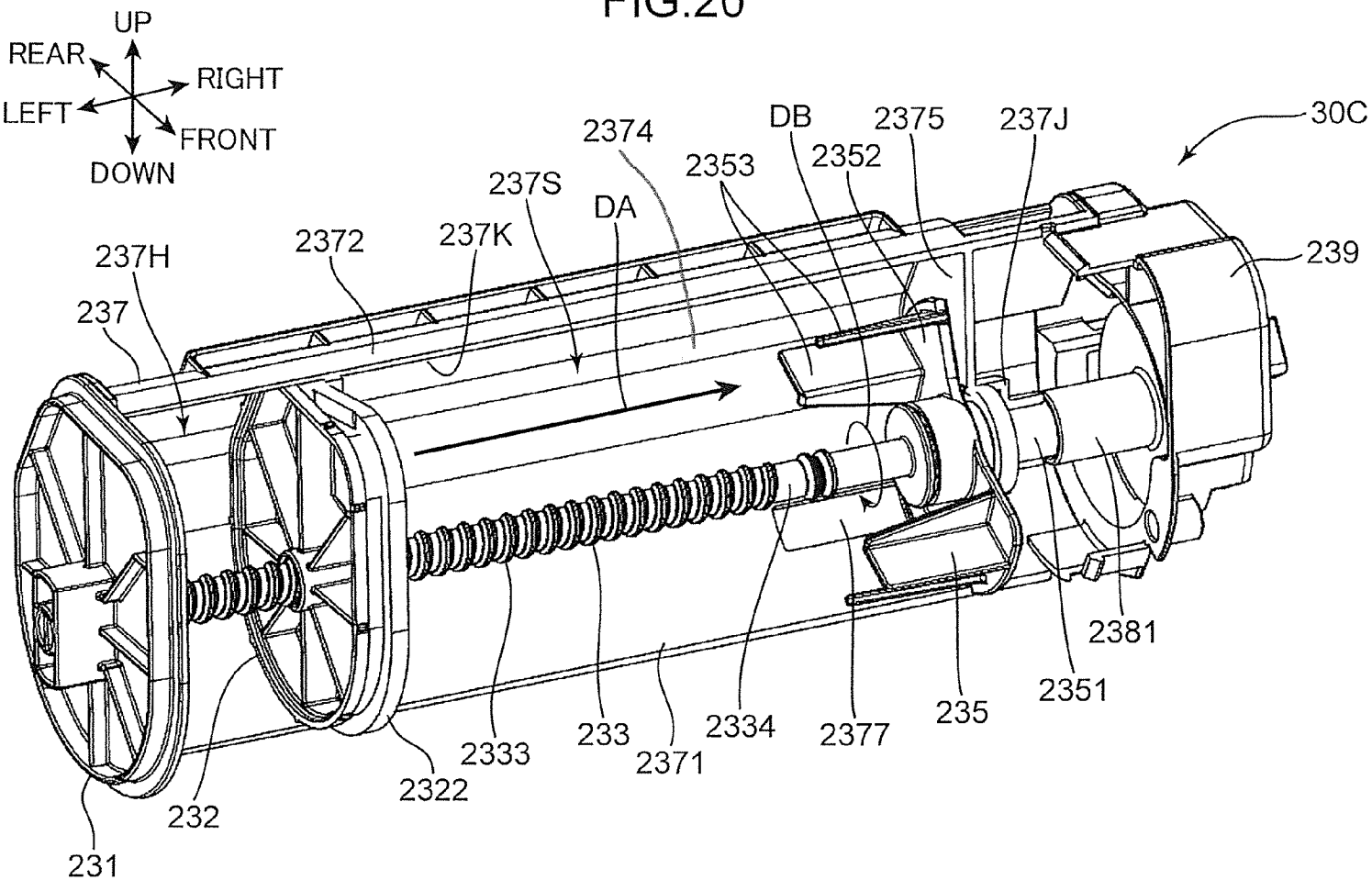
FIG. 20 is a perspective view showing the inside of the developer housing container shown in FIG. 19.
Figure 21:
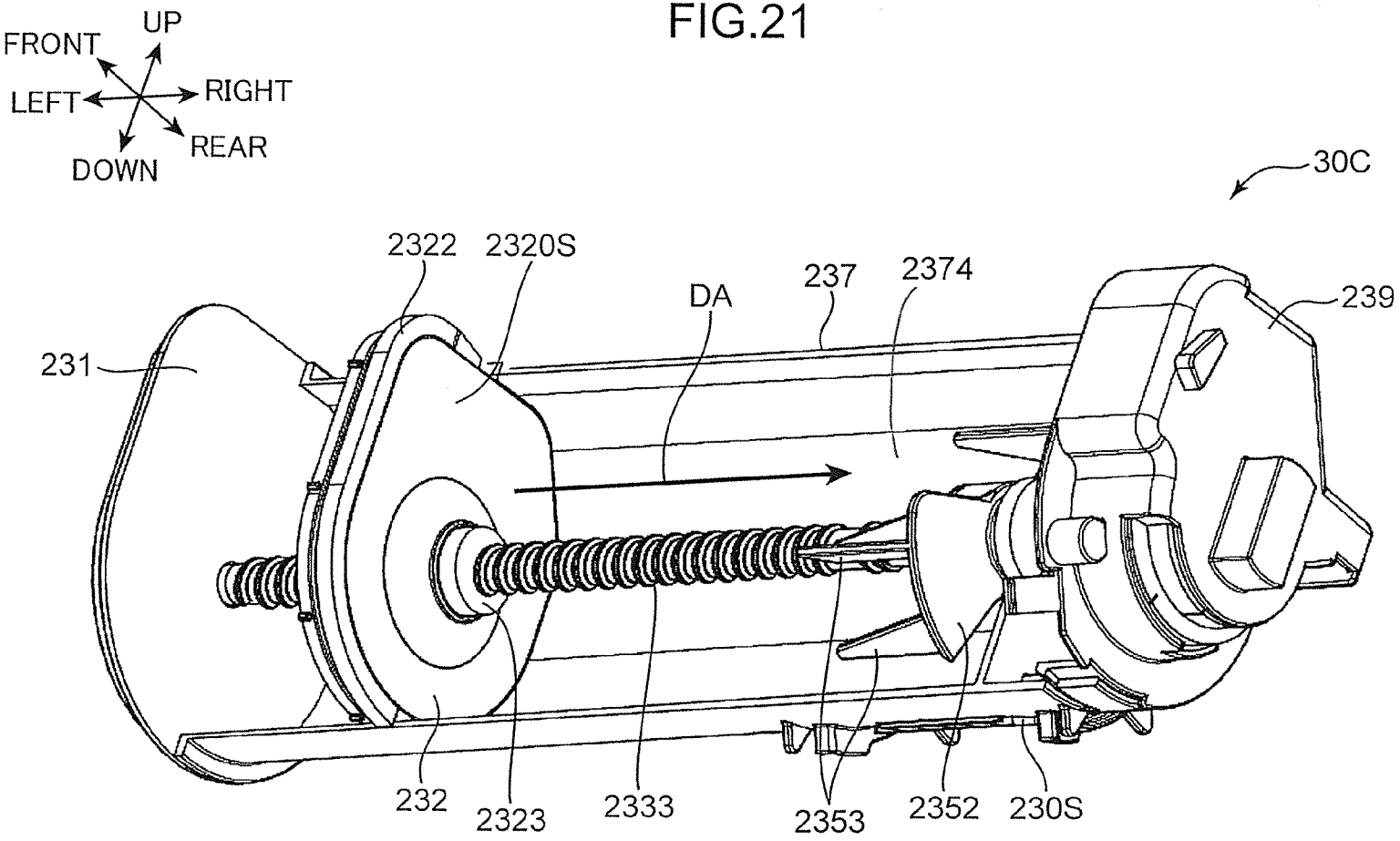
FIG. 21 is a perspective view showing the inside of the developer housing container shown in FIG. 19.
Figure 22:
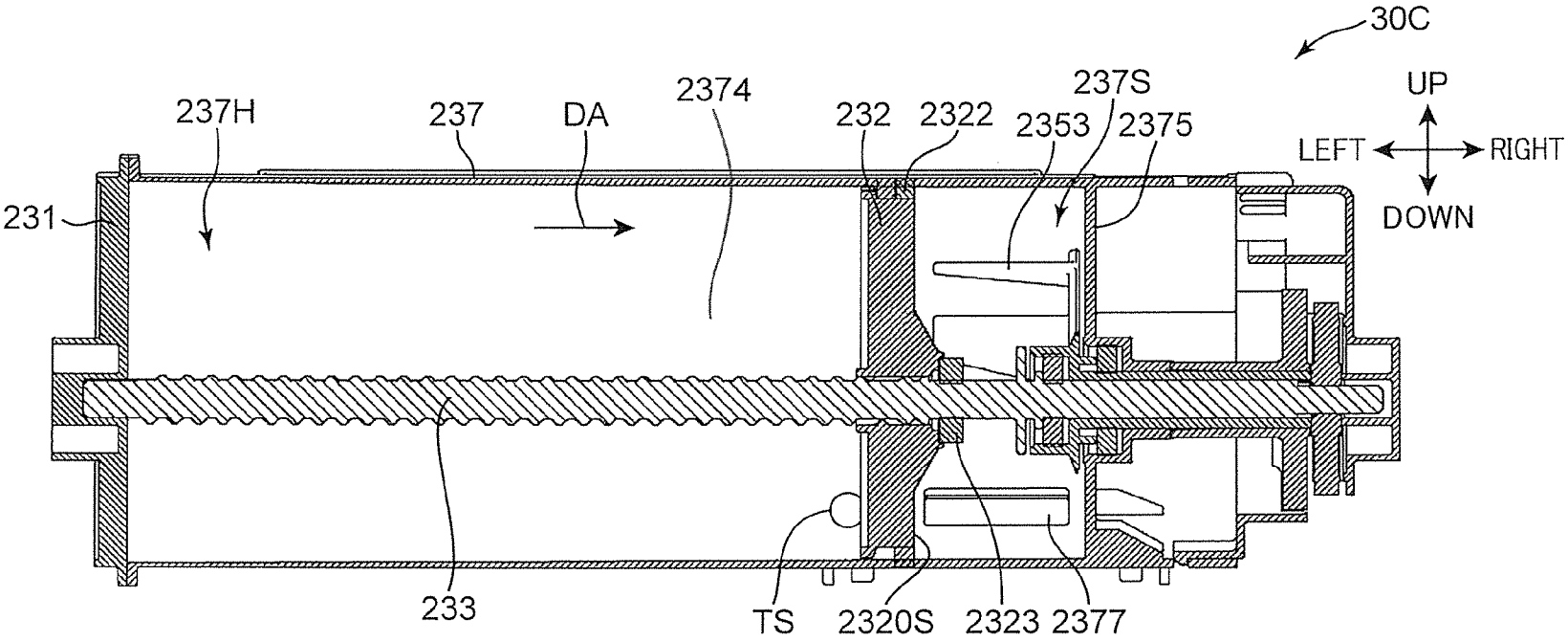
FIG. 22 is a sectional view showing how a moving wall moves in a container main body.

Next, a toner container 30C (a developer housing container) according to a second embodiment of the present disclosure will be described with reference to FIGS. 19 to 22. FIG. 19 is a sectional view in a horizontal direction of the toner container 30C according to the second embodiment, and FIGS. 20 and 21 are perspective views showing an internal state of the toner container 30C. Moreover, FIGS. 20 and 21 are perspective views in which a container main body 237 of the toner container 30C has been partially omitted. FIG. 22 is a sectional view showing a moving wall 232 having reached a final position in the toner container 30C.

The toner container 30C is constituted by a cylindrical body extending in a horizontal direction (a first direction, a direction indicated by an arrow DA) and houses replenishing toner (developer) therein. The toner container 30C includes a lid section 231, the moving wall 232, a shaft 233, a stirring member 235, the container main body 237 (a container main body), a toner sensor TS, a first gear 2381, a second gear 2382, and a cover 239.

The lid section 231 is fixed to the container main body 237 and seals an opening of the container main body 237. The lid section 231 includes a lid shaft hole section 231J. The lid shaft hole section 231J is provided at a central portion of the lid section 231 and rotatably supports the shaft 233. The lid shaft hole section 231J is a hole section formed in a prescribed length to the left from a right-side side surface (inner surface portion) of the lid section 231.

The container main body 237 is a main body portion of the toner container 30C having a cylindrical shape. The container main body 237 includes an inner peripheral section 237K and an internal space 237H. The inner peripheral section 237K is an inner peripheral surface of the container main body 237 and defines the internal space 237H extending in a cylindrical shape in the horizontal direction of the toner container 30C.

The container main body 237 includes a bottom section 2371, a top plate 2372, a rear wall 2374, a front wall (not shown) opposite the rear wall, a right wall 2375, and a protruded wall 2376. The bottom section 2371 is a bottom portion of the container main body 237 and has a half-cylindrical shape that protrudes downward. In other words, the bottom section 2371 has an arc shape in a sectional view intersecting the first direction. The front wall and the rear wall 2374 are a pair of side walls erected upward from side ends of the bottom section 2371. The top plate 2372 is arranged above the bottom section 2371 and covers the internal space 237H from above. The right wall 2375 is consecutively provided on the side of one end (a right end side) in the first direction of the bottom section 2371, the front wall (not shown), the rear wall 2374, and the top plate 2372 and is a wall portion that closes the container main body 237.

Moreover, the internal space 237H is a space defined by the inner peripheral section 237K formed by the bottom section 2371, the top plate 2372, the front wall, and the rear wall 2374, and by the right wall 2375 and the lid section 231. In addition, a region between the right wall 2375 and the moving wall 232 in the internal space 237H is considered a housing space 237S. The housing space 237S is a space that houses toner inside the toner container 30C.

A left end side of the container main body 237 is opened and the opening is closed by the lid section 231. An outer peripheral edge of the lid section 231 is ultrasonically welded to the container main body 237. The protruded wall 2376 is a portion where an outer peripheral section of the container main body 237 protrudes further rightward than the right wall 2375. The cover 239 is mounted to the protruded wall 2376.

The container main body 237 includes a toner discharge port 2377 (a developer discharge port), a shutter 230S (FIG. 21), and a main body bearing section 237J. The toner discharge port 2377 is an opening in a lower surface portion of the container main body 237 which communicates with the internal space 237H. The toner discharge port 2377 is arranged on a right end side of the container main body 237. In addition, the toner discharge port 2377 is opened in a rectangular shape with a prescribed length in the first direction and a prescribed width along the arc shape of the bottom section 2371. In the present embodiment, the toner discharge port 2377 is opened at a position that is offset rearward and upward in a peripheral direction from a lower end portion of the bottom section 2371. Toner housed in the housing space 237S is discharged from the toner discharge port 2377.

The shutter 230S is slidably arranged in a right end portion of the container main body 237. The shutter 230S closes (seals) the toner discharge port 2377 from an outer side of the container main body 237 and, at the same time, exposes the toner discharge port 2377 to the outside. A sliding movement of the shutter 230S is interlocked with a mounting operation of the toner container 30C to the developing apparatus 20.

The main body bearing section 237J is a bearing formed on the right wall 2375. The main body bearing section 237J has a cylindrical shape that protrudes rightward from a central portion of the right wall 2375. The shaft 233 is inserted to the main body bearing section 237J. In doing so, a right end side of the shaft 233 protrudes to the outside of the container main body 237. Furthermore, inside the cylinder of the main body bearing section 237J, a part of the stirring member 235 (a stirring bearing section 2351) is inserted between the main body bearing section 237J and the shaft 233.

The moving wall 232 is a wall portion that is arranged facing the first direction (the horizontal direction) inside the container main body 237 (in the internal space 237H). The moving wall 232 defines one end surface (a left end surface) in the first direction of the housing space 237S. Moreover, the other end surface (the right end surface) in the first direction of the housing space 237S is defined by the right wall 2375. In addition, the moving wall 232 has a function of, during a period from the start of use to the end of use of the toner container 30C, moving inside the internal space 237H in the first direction from an initial position on one end side to a final position on the other end side in the first direction while conveying toner in the housing space 237S toward the toner discharge port 2377.

In the present embodiment, the initial position of the moving wall 232 is arranged to the right of the lid section 231 and the final position is set directly to the left of the toner discharge port 2377. Moreover, the initial position of the moving wall 232 is set on an upstream side in the first direction with respect to a detection surface of the toner sensor TS (to be described later). In addition, the final position of the moving wall 232 is set so that at least a part of the detection surface of the toner sensor TS is arranged on an upstream side in the first direction with respect to the moving wall 232.

The moving wall 232 includes a conveyance surface 2320S, an inner wall seal 2322, a shaft seal 2323, a bearing section 232J, and an outer peripheral section 232K. Moreover, a main body portion of the moving wall 232 excluding the inner wall seal 2322 and the shaft seal 2323 is made of a nonmagnetic resin material.

The conveyance surface 2320S is a wall surface that intersects an axial direction of the shaft 233. As the moving wall 232 moves, the conveyance surface 2320S presses and conveys the toner in the housing space 237S.

The bearing section 232J is a bearing section formed approximately in a central portion of the moving wall 232. The bearing section 232J moves in the first direction while holding the moving wall 232. The shaft 233 is inserted to the bearing section 232J. The bearing section 232J includes a female spiral section 2320D. The female spiral section 2320D is a spiral screw section formed on an inner peripheral surface of the bearing section 232J. The female spiral section 2320D moves the moving wall 232 in the first direction by engaging with a male spiral section 2333 of the shaft 233.

The inner wall seal 2322 is a seal member arranged so as to cover a periphery of the moving wall 232. An elastic member made of urethane sponge is suitable as the inner wall seal 2322. The inner wall seal 2322 compressedly deforms between the inner peripheral section 237K and the moving wall 232. In addition, the inner wall seal 2322 forms the outer peripheral section 232K of the moving wall 232. The outer peripheral section 232K is slidably arranged in close proximity to the inner peripheral section 237K. Due to the inner wall seal 2322, toner in the housing space 237S is prevented from flowing out toward an upstream side in a direction of movement with respect to the moving wall 232 from between the inner peripheral section 237K and the moving wall 232.

The shaft seal 2323 is fixed to a tip side in a direction of movement of the moving wall 232 with respect to the female spiral section 2320D in the bearing section 232J. The shaft seal 2323 is an elastic member made of urethane sponge. The shaft seal 2323 comes into contact with the male spiral section 2333 before the female spiral section 2320D and cleans toner adhered to the male spiral section 2333. In addition, the shaft seal 2323 prevents the toner in the housing space 237S from passing through the bearing section 232J and flowing out toward the upstream side in the direction of movement with respect to the moving wall 232.

The shaft 233 is rotatably supported by the right wall 2375 of the container main body 237 and the lid section 231 so as to extend in the first direction in the internal space 237H. The shaft 233 includes a first shaft end section 2331, a second shaft end section 2332, the male spiral section 2333, and a moving wall stopping portion 2334.

With reference to FIG. 19, the first shaft end section 2331 is a right end portion of the shaft 233 which penetrates the main body bearing section 237J and protrudes to the right. The second shaft end section 2332 is a left end portion of the shaft 233. The second shaft end section 2332 is pivotally supported by the lid shaft hole section 231J formed in the lid section 231.

The male spiral section 2333 is a spiral screw section formed on an outer peripheral surface of the shaft 233 in the internal space 237H. The male spiral section 2333 is arranged from a region adjacent to the lid section 231 to a region on an upstream side in the first direction with respect to the toner discharge port 2377 of the shaft 233. The moving wall stopping portion 2334 is arranged consecutively on a downstream side in the first direction to the male spiral section 2333. The moving wall stopping portion 2334 is a region in which the male spiral section 2333 has been partially omitted and which is constituted only by a shaft portion of the shaft 233.

The stirring member 235 is arranged along the right wall 2375 above the toner discharge port 2377. The stirring member 235 stirs the toner in the housing space 237S and, at the same time, sends out the toner from the toner discharge port 2377. The stirring member 235 rotates around the shaft 233 and rotates relative to the shaft 233. In FIG. 20, a direction of rotation of the stirring member 235 is indicated by an arrow DB. The stirring member 235 includes a stirring bearing section 2351, a stirring supporting section 2352, and a stirring blade 2353.

The stirring bearing section 2351 has a cylindrical shape that is fitted to the outside of the shaft 233. The stirring bearing section 2351 is inserted to the main body bearing section 237J from the side of the housing space 237S. As a result, a right end side of the stirring bearing section 2351 penetrates the main body bearing section 237J and is exposed to the outside of the container main body 237 with respect to the right wall 2375 (the main body bearing section 237J). On the other hand, a left end side of the stirring bearing section 2351 is arranged inside the housing space 237S.

The stirring supporting section 2352 is a protruding piece provided so as to protrude in a radial direction of rotation of the shaft 233 from the left end side of the stirring bearing section 2351 having a cylindrical shape. The stirring supporting section 2352 is arranged facing the first direction along the right wall 2375. The stirring supporting section 2352 rotates around the shaft 233 in the housing space 237S. In the present embodiment, the stirring supporting section 2352 is arranged in a pair. The pair of stirring supporting sections 2352 is arranged so that the stirring supporting sections 2352 respectively extend toward opposite sides in the radial direction, and has a propeller shape whose width in a peripheral direction is set wide toward an outer side in the radial direction (FIG. 21).

The stirring blade 2353 is a blade member provided so as to protrude to the left from the pair of stirring supporting sections 2352. Two stirring blades 2353 are provided so as to protrude from each stirring supporting section 2352 at an interval in a peripheral direction of rotation of the stirring member 235. While revolving above the toner discharge port 2377, the stirring blades 2353 stir the toner around the toner discharge port 2377 and, at the same time, discharge the toner from the toner discharge port 2377.

The first gear 2381 is coupled to the stirring bearing section 2351 and transmits a rotational driving force to the stirring member 235. The first gear 2381 is coupled to a first motor M1 via a transmission gear (not shown) of the developing apparatus 20. In addition, the stirring member 235 is rotationally controlled by a control unit 500 in synchronization with the developing roller 21 of the developing apparatus 20 during a developing operation.

The second gear 2382 transmits a rotational driving force to the shaft 233. The second gear 2382 is coupled to a tip section (the first shaft end section 2331) of the shaft 233 penetrating the stirring bearing section 2351. The second gear 2382 is coupled to a second motor M2 via a transmission gear (not shown) of the developing apparatus 20. In addition, the shaft 233 is rotationally controlled by the control unit 500 independent of the stirring member 235 and the moving wall 232 moves in the first direction.

The cover 239 is mounted to the protruded wall 2376 of the container main body 237. The cover 239 exposes parts of the first gear 2381 and the second gear 2382 in a peripheral direction to the outside and, at the same time, covers the other parts of the first gear 2381 and the second gear 2382 in the peripheral direction.

The toner sensor TS is a sensor arranged in the bottom section 2371 of the container main body 237. The toner sensor TS is fixed to the bottom section 2371 at an interval on an upstream side in the first direction with respect to the toner discharge port 2377. The toner sensor TS is constituted by a permeability sensor. The toner sensor TS is arranged so as to oppose the housing space 237S and includes a detection surface capable of detecting the presence or absence of magnetic toner.

The toner sensor TS outputs a HIGH signal (+5 V) when detecting toner in the housing space 237S. In addition, in a case where toner hardly exists in a region opposed by the toner sensor TS in the housing space 237S, the toner sensor TS outputs a LOW signal (0 V). Output signals of the toner sensor TS are referred to by the control unit 500. Moreover, when the toner sensor TS is a permeability sensor as in the case described above, the sensor need not come into direct contact with the toner. Therefore, in other embodiments, the toner sensor TS may be arranged on a side of the developing housing 210 of the developing apparatus 20 so as to oppose an outer wall of the container main body 237. Furthermore, a position of the toner sensor TS is not limited to the bottom section 2371. In other embodiments, the toner sensor TS may be arranged on the top plate 2372, the front wall, the rear wall 2374, and the like of the container main body 237.

In the second embodiment, the printer 100 includes the control unit 500 (a remaining amount detecting unit), the first motor M1, and the second motor M2. The control unit 500 detects a remaining toner amount (a remaining developer amount) in the toner container 30C in accordance with an output of the toner sensor TS. In addition, the control unit 500 causes the moving wall 232 to move in the first direction in accordance with an output of the toner sensor TS. The first motor M1 generates a drive force that causes the stirring member 235 to rotate and a drive force that causes various members of the developing apparatus 20 to rotate. The second motor M2 generates a drive force that causes the shaft 233 to rotate and causes the moving wall 232 to move.

[Movement of Moving Wall in Second Embodiment]

When a new toner container 30C is mounted to the printer 100, the control unit 500 rotationally drives the shaft 233 via the second gear 2382. As a result, due to engagement of the male spiral section 2333 of the shaft 233 and the female spiral section 2320D of the moving wall 232, the moving wall 232 arranged at the initial position moves toward the toner discharge port 2377 in the first direction (the direction indicated by the arrow DA in FIGS. 19 to 22). Subsequently, when the moving wall 232 moves by a prescribed distance to the right from the initial position, the housing space 237S is filled with toner and the toner sensor TS outputs a HIGH signal corresponding to a full state. Upon receiving the HIGH signal output from the toner sensor TS, the control unit 500 stops the moving wall 232.

In the present embodiment, the inner peripheral section 237K of the container main body 237 and the outer peripheral section 232K of the moving wall 232 have non-circular shapes in a sectional view intersecting the first direction. In addition, the outer peripheral section 232K in close contact with the inner peripheral section 237K has a shape similar to that of the inner peripheral section 237K. Therefore, even when a rotational force around the shaft 233 is applied to the moving wall 232 due to the engagement of the male spiral section 2333 and the female spiral section 2320D, the moving wall 232 is prevented from rotating (corotating) around the shaft 233.

In a similar manner to the first embodiment, it is assumed that the second embodiment also adopts a volume-based replenishing-type toner replenishing method (FIG. 4B). In this case, when the conveying capability suppressing unit 27 (FIG. 4A) of the developing apparatus 20 is sealing the toner replenishing port 25 from below, replenishing toner is less likely to drop from the toner container 30C. On the other hand, when toner is consumed and the toner at the conveying capability suppressing unit 27 decreases, toner flows into the developing apparatus 20 from the toner discharge port 2377 via the toner replenishing port 25. As a result, since toner around the toner sensor TS disappears in the housing space 237S of the toner container 30C, the toner sensor TS outputs a LOW signal. Having received the signal, the control unit 500 further moves the moving wall 232 toward the toner discharge port 2377 until the toner sensor TS outputs a HIGH signal.

The control unit 500 rotates the stirring member 235 in accordance with a developing operation of the developing apparatus 20. As a result, since the stirring member 235 arranged on a right end side of the housing space 237S rotates around the shaft 233, the toner above the toner discharge port 2377 is stirred in a stable manner. Therefore, flowability of the toner increases and the toner drops from the toner discharge port 2377 in a stable manner. In the present embodiment, the stirring blade 2353 is provided so as to protrude from the stirring supporting section 2352 of the stirring member 235. Therefore, toner around the toner discharge port 2377 is actively stirred by a revolving movement of the stirring blade 2353.

When the toner in the housing space 237S of the toner container 30C continues to be used, the moving wall 232 eventually reaches the final position immediately before the toner discharge port 2377 as shown in FIG. 22. As described, as the moving wall 232 gradually moves in the first direction, the toner in the housing space 237S is pressed by the moving wall 232 and conveyed to the toner discharge port 2377. Therefore, an amount of toner remaining in the housing space 237S upon end of use is reduced.

In the present embodiment, the moving wall 232 stops slightly on the upstream side in the first direction of the toner discharge port 2377 (final position). More specifically, when the bearing section 232J of the moving wall 232 reaches the moving wall stopping portion 2334 in accordance with the movement of the moving wall 232, the engagement between the male spiral section 2333 and the female spiral section 2320D is released. As a result, transmission of moving force from the shaft 233 to the moving wall 232 is lost and the moving wall 232 stops at the final position.

At this point, since space remains above the toner discharge port 2377, a small amount of toner remains in the space. However, due to the stirring member 235 being rotationally driven, the toner can be discharged from the toner discharge port 2377 in a stable manner until the end. Moreover, the toner discharge port 2377 is opened at a position that is slightly offset upward from the lower end portion of the container main body 237. Even in this case, toner remaining in a lowermost end portion of the container main body 237 is scooped up by the stirring blade 2353 and then discharged from the toner discharge port 2377 in a stable manner.

Figure 23:
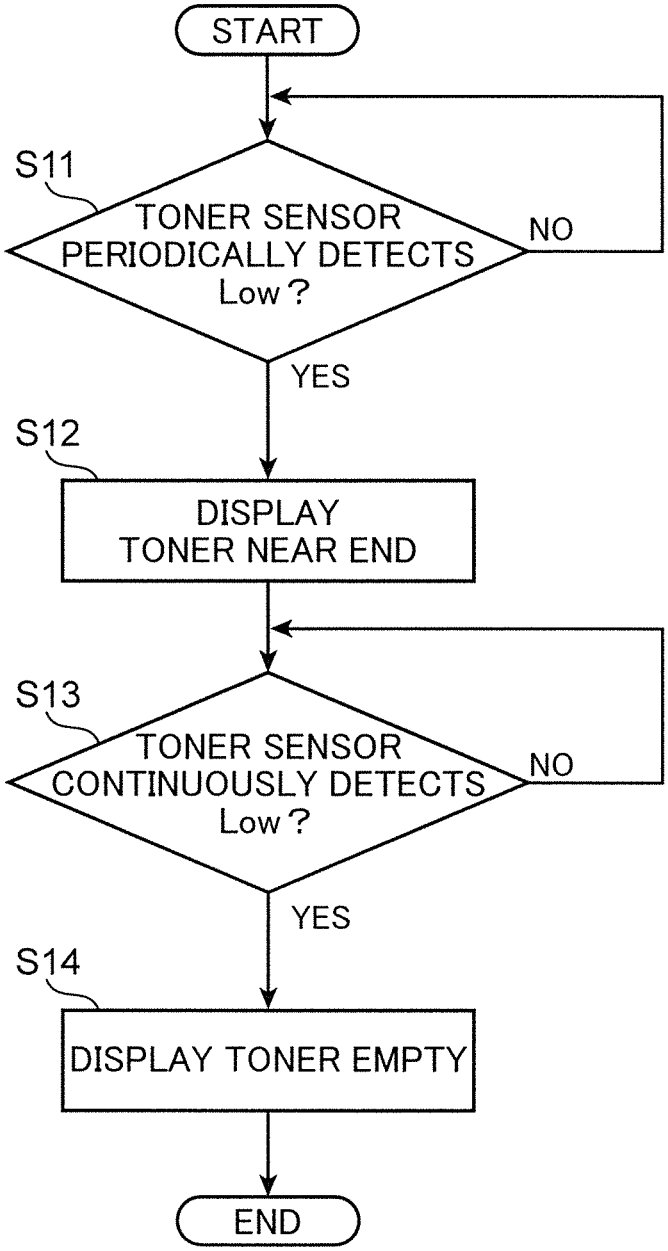
FIG. 23 is a flow chart showing a detection operation of a toner sensor.

FIG. 23 is a flow chart showing a detection operation of the toner sensor TS. When printing operations are repetitively performed after the toner container 30C is mounted to the printer 100, a gradual movement of the moving wall 232 in the first direction is triggered by a LOW signal of the toner sensor TS as described earlier. At this point, the control unit 500 determines whether or not the LOW signal of the toner sensor TS is periodically detected in a detection period set in advance (step S11). Moreover, in the present embodiment, the detection period is set to 10 seconds and the detection operation in step S1 is executed during a period of time where a developing operation is being executed by the developing apparatus 20. In addition, periodicity of outputs of the LOW signal is determined based on, for example, whether or not the outputs exceed 5 times in 10 seconds.

When toner in the housing space 237S decreases, the toner sensor TS begins to frequently output a LOW signal even when the moving wall 232 is moved in the first direction. In other words, in step S11, when the toner sensor TS periodically outputs a LOW signal (YES in step S11), the control unit 500 causes a prescribed display unit to display toner-near-end information (information indicating that toner will soon be used up, developer-near-end information) (step S12). Accordingly, the fact that the toner container 30C is approaching empty can be promptly notified to the user.

When the toner sensor TS does not periodically output the LOW signal within the prescribed period of time (NO in step S11), the toner in the toner container 30C continues to be consumed while the moving wall 232 is being moved in the first direction.

Furthermore, when the moving wall 232 is moved in the first direction in the toner-near-end state, the moving wall 232 eventually reaches the final position shown in FIG. 22. At this point, a part of the detection surface of the toner sensor TS is arranged on the upstream side in the first direction with respect to the moving wall 232. Since toner does not exist in a region opposed by the detection surface, the toner sensor TS continues to output the LOW signal. As a result, due to the output by the toner sensor TS, the fact that the moving wall 232 has reached the final position and that the toner container 30C is empty (or almost empty) can be promptly recognized.

In other words, when the toner sensor TS continuously outputs the LOW signal during the 10-second period (YES in step S13), the control unit 500 causes the display unit to display toner empty information (information indicating that there is no more toner, developer empty information) (step S14). At this point, the control unit 500 may place the printer 100 in a machine-locked state (a printing-disabled state) in order to prevent a decline in density in a printed image.

When the toner sensor TS does not continuously output the LOW signal during the prescribed period of time in the toner-near-end state (NO in step S13), the toner in the toner container 30C continues to be consumed. In addition, even when the moving wall 232 reaches the final position, there may be cases where a small amount of toner remains between the moving wall 232 and the right wall 2375 as described earlier. Therefore, a mode may be adopted where the user is notified of the toner empty information and, at the same time, a printing operation of the printer 100 is permitted within a prescribed number of sheets.

As described above, in the second embodiment, at least a part of the toner sensor TS is arranged on the upstream side in the first direction with respect to the moving wall 232 having reached the final position. Therefore, the toner sensor TS can transmit an output signal in accordance with the internal space 237H in which toner is not housed. Furthermore, in the present embodiment, the housing space 237S houses magnetic toner, the toner sensor TS is a permeability sensor, and the moving wall 232 is made of a nonmagnetic material. Therefore, the toner sensor TS can transmit output signals in an accurate manner in accordance with the presence or absence of magnetic toner. In addition, when the moving wall 232 reaches the final position, the fact that the toner container 30C has become empty can be promptly recognized as the moving wall 232 or the internal space 237H in which toner is not housed opposes the toner sensor TS.

In the present embodiment, the moving wall 232 includes the inner wall seal 2322. Therefore, as shown in FIG. 22, as the moving wall 232 moves toward and reaches the final position the inner wall seal 2322 can wipe off toner adhering to the detection surface of the toner sensor TS or toner adhering to the inner peripheral section 237K of the container main body 237 that is adjacent to the detection surface. As a result, the fact that the moving wall 232 has reached the final position and that the toner container 30C has become empty can be recognized in a prompt and reliable manner.

According to the first and second embodiments of the present disclosure described above, an amount of toner remaining in the container main bodies 31 and 237 upon end of use of the toner containers 30 and 30C is reduced. Therefore, while the toner in the toner containers 30 and 30C is being efficiently replenished to the developing apparatus 20, an image is formed on the sheet S in a stable manner. Furthermore, the fact that the toner containers 30 and 30C have become empty is promptly recognized. Therefore, in the printer 100, a significant decrease in the toner in the developing apparatus 20 can be suppressed and failures such as a decline in density can be prevented.

Modified Embodiments

While the toner containers 30 and 30C and the printer 100 provided with the toner containers 30 and 30C according to embodiments of the present disclosure have been described above, the present disclosure is not limited thereto. The present disclosure can adopt modified embodiments such as those described below.

(1) In the present disclosure, a specific mode thereof is not limited as long as a sensor that detects a prescribed detection object is arranged at a position that enables the sensor to generate different outputs between before and after a moving wall reaches a prescribed position on a movement route and a determining unit determines a state where there is no toner in a toner container when the sensor generates an output determined in advance. In the first embodiment, the toner sensor 31T as the sensor described above is arranged in a vicinity of the toner discharge port 319 and detects the detection piece 40 that integrally moves with the moving wall 34. In addition, the determining unit 52 detects toner empty based on an output of the toner sensor 31T upon detection of the detection piece 40. In the second embodiment, the toner sensor TS is arranged on an upstream side of the moving wall 232 having reached the final position. Accordingly, by creating a state where toner is reliably absent on the detection surface of the toner sensor TS at the final position, the control unit 500 detects toner empty. Any mode other than those described above may be adopted as long as the sensor generates an output enabling toner empty to be identified in association with a movement of the moving wall.

(2) In the first embodiment, an example is shown in which the detection piece 40 is attached to the moving wall 34 in a state where the detection piece 40 protrudes toward a downstream side from the conveyance surface 340S of the moving wall 34. Alternatively, the detection piece 40 may be mounted in a mode where the detection piece 40 is embedded inside the moving wall 34. In this case, the moving wall 34 can be moved to a position very close to the left end wall of the container main body 31 in accordance with the lack of protrusion of the detection piece 40 and a remaining amount of toner can be further reduced. In addition, an advantage may be gained in that the toner discharge port 319 can be closed by the moving wall 34.

(3) In the first embodiment, an example is shown in which the detection piece 40 is a magnetic body and the toner sensor 31T is a permeability sensor. This combination is merely an example. For example, a sensing system with a combination that measures an amount of electricity such as capacitance or inductance, an optical sensing system, or a sensing system with a combination that wirelessly measures an IC tag or the like can be applied. Alternatively, a mechanical sensing system may be adopted such as arranging a member that mechanically interferes with the moving wall 34 inside the container main body 31.

(4) In the second embodiment, the toner sensor TS may be a pressure sensor. In this case, by exposing at least a part of the detection surface of the toner sensor TS to the internal space 237H, pressure on the detection surface of the toner sensor TS is reduced and output voltage of the toner sensor TS declines. Therefore, the fact that there is no toner in the toner container 30C can be promptly recognized.

(5) In the second embodiment, a mode is described in which a remaining toner amount in the toner container 30C is recognized in accordance with an output of the toner sensor TS and the moving wall 232 is moved in accordance with the output. Alternatively, the toner sensor TS may be used only for recognizing a remaining toner amount in the toner container 30C (for detecting that the moving wall 232 has reached the final position) and the movement of the moving wall 232 may be controlled based on output of another sensor. As an example, when output of a remaining toner amount sensor (not shown) provided in the developing housing 210 of the developing apparatus 20 decreases, the moving wall 232 may be moved in the first direction in order to replenish toner in the developing housing 210. Alternatively, the moving wall 232 may be moved in the first direction in accordance with a printing rate at which printing is performed by the printer 100.

(6) In the second embodiment, a mode is described in which a remaining toner amount in the toner container 30C is detected in accordance with an output mode (periodic or continuous) of a LOW signal of the toner sensor TS. Alternatively, the toner sensor TS may include three different output signals (output voltages). As an example, the toner sensor TS may output a HIGH signal (5 V) when a large amount of magnetic toner opposes the detection surface of the toner sensor TS, a MIDDLE signal (2 V) when a small amount of magnetic toner opposes the detection surface, and a LOW signal (0 V) when no magnetic toner opposes the detection surface. The LOW signal is output when the moving wall 232 has reached the final position and the detection surface of the toner sensor TS is exposed to the internal space 237H that does not include any toner. In this case, the control unit 500 may move the moving wall 232 in the first direction accordance with the HIGH signal and the MIDDLE signal, and when the LOW signal is output, the control unit 500 may detect empty of the toner container 30C.

(7) In the embodiments presented above, modes have been described in which the shafts 33 and 233 include male spiral sections 333 and 2333 and moving wall stopping portion 334 and 2334. Alternatively, the male spiral sections 333 and 2333 may be arranged over entire shafts 33 and 233 in the first direction. In this case, in the second embodiment, the stirring member 235 desirably does not include the stirring blade 2353 and is solely constituted by the stirring supporting section 2352. Toner above the toner discharge port 2377 can also be stirred by rotation of the stirring supporting section 2352. In addition, the moving wall 232 may move along the male spiral section 2333 until the conveyance surface 2320S of the moving wall 232 approaches the stirring supporting section 2352.

(8) In the second embodiment described above, the final position of the moving wall 232 is set so that at least a part of the detection surface of the toner sensor TS is arranged on an upstream side in the first direction with respect to the moving wall 232. Alternatively, the final position of the moving wall 232 may be set so that the entire detection surface of the toner sensor TS is arranged on an upstream side in the first direction with respect to the moving wall 232. In this case, the toner sensor TS becomes capable of transmitting an output signal (continuous LOW signal) in accordance with the internal space 237H that does not house any toner in an accurate manner. As a result, the fact that the toner container 30C has become empty can be recognized in a more prompt and reliable manner as compared to the embodiments described above.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer replenishing apparatus, comprising:

a developer housing container that houses developer, the developer housing container includes:

a container main body having a wall that partitions an internal space;

a shaft section arranged so as to extend in a first direction in the internal space;

a moving wall configured to move from an initial position set at an upstream side to a final position set at downstream side in the first direction along the shaft section in the internal space and that conveys the developer; and a developer discharge port arranged near a downstream end in the first direction of the container main body and that penetrates the wall and allows communication between the internal space and an outside;

a sensor that detects a prescribed detection object and generates an electrical output, the sensor being arranged to oppose the internal space and includes a detection surface capable of detecting a presence or absence of the developer; and a determining unit that determines a presence or absence of developer inside the developer housing container based on the output from the sensor, wherein the sensor is arranged at a position that enables the sensor to generate different outputs between before and after the moving wall reaches a prescribed position on a movement route, the determining unit determines a state where there is no developer in the developer housing container when the sensor generates an output determined in advance, the initial position of the moving wall is set on the upstream side in the first direction with respect to the detection surface of the sensor, and the final position of the moving wall is set so that at least a part of the detection surface of the sensor is arranged on the upstream side in the first direction with respect to the moving wall.

2. The developer replenishing apparatus according to claim 1, wherein the final position of the moving wall is set so that the entire detection surface of the sensor is arranged on the upstream side in the first direction with respect to the moving wall.

3. The developer replenishing apparatus according to claim 2, wherein the developer is magnetic toner, the sensor is a permeability sensor, and the moving wall is made of a nonmagnetic material.

4. The developer replenishing apparatus according to claim 2, wherein the sensor is a pressure sensor.

5. The developer replenishing apparatus according to claim 2, further comprising a seal member which is arranged in an outer peripheral section of the moving wall and which compressedly deforms between an inner peripheral section of the container main body and the moving wall.

6. The developer replenishing apparatus according to claim 1, further comprising:

a remaining amount detecting unit that detects a remaining developer amount in the developer housing container in accordance with the output of the sensor; and a display unit that displays remaining amount information in accordance with the remaining developer amount, wherein the remaining amount detecting unit causes the display unit to display developer-near-end information when the sensor periodically detects that there is no developer within a prescribed period of time.

7. The developer replenishing apparatus according to claim 6, wherein the remaining amount detecting unit causes the display unit to display developer empty information when the sensor continuously detects that there is no developer within a prescribed period of time.

8. An image forming apparatus, comprising:

the developer replenishing apparatus according to claim 1;

an image bearing member that bears an electrostatic latent image and a developer image;

a developing apparatus to which the developer is supplied from the developer replenishing apparatus and which supplies the developer to the image bearing member; and a transferring unit which transfers the developer image from the image bearing member to a sheet.

9. A developer replenishing apparatus, comprising:

a developer housing container that houses developer, the developer housing container including:

a container main body having a wall that partitions an internal space, a shaft section arranged to extend in a first direction in the internal space, a moving wall that moves from an upstream side to a downstream side in the first direction along the shaft section in the internal space and that conveys the developer, the moving wall including a detection piece, and a developer discharge port arranged near a downstream end in the first direction of the container main body and that penetrates the wall and allows communication between the internal space and an outside;

a sensor that detects the detection piece and generates an electrical output, the sensor being arranged at a position that enables the sensor to generate different outputs between before and after the moving wall reaches a prescribed position on a movement route and that enables the detection piece to be detected when the moving wall approaches the developer discharge port, the sensor further being capable of detecting a common physical quantity between the developer and the detection piece; and a determining unit that determines a presence or absence of developer inside the developer housing container based on the output from the sensor, the determining unit determines a state where there is no developer in the developer housing container when the sensor generates an output determined in advance.

10. The developer replenishing apparatus according to claim 9, wherein the developer is magnetic toner including a magnetic component, the sensor is a sensor that detects magnetism, the detection piece is constituted by a magnetic body, and the sensor outputs a prescribed first value when detecting the magnetic toner and outputs a second value that is higher than the first value when detecting the detection piece.

11. The developer replenishing apparatus according to claim 10, further comprising a control unit that controls movement of the moving wall, wherein the sensor outputs a third value that is lower than the first value when not detecting the magnetic toner, and the control unit:

temporarily renders the moving wall in a stopped state when the sensor is outputting the first value;

moves the moving wall toward the downstream side in the first direction by a prescribed amount when the sensor outputs the third value; and permanently renders the moving wall in a stopped state when and after the sensor outputs the second value.

12. The developer replenishing apparatus according to claim 9, wherein the moving wall includes a conveyance surface perpendicular to the shaft section on a surface facing the downstream side in the first direction, and the detection piece is attached to the moving wall in a state where the detection piece protrudes toward the downstream side from the conveyance surface.

13. The developer replenishing apparatus according to claim 9, wherein the detection piece has a shape with different areas per unit length in the first direction.

14. The developer replenishing apparatus according to claim 13, wherein the detection piece includes a first detection region on the downstream side and a second detection region on the upstream side in the first direction, and a non-detection region that does not become a detection object of the sensor is arranged between the first detection region and the second detection region.

15. The developer replenishing apparatus according to claim 9, wherein the sensor is arranged so as to oppose the internal space and includes a detection surface capable of detecting a presence or absence of the developer, the moving wall is configured to move from an initial position set on the upstream side in the first direction to a final position set on the downstream side in the first direction, the initial position of the moving wall is set on the upstream side in the first direction with respect to the detection surface of the sensor, and the final position of the moving wall is set so that at least a part of the detection surface of the sensor is arranged on the upstream side in the first direction with respect to the moving wall.

* * * * *